US006246848B1

(12) United States Patent
Morinaga et al.

(10) Patent No.: US 6,246,848 B1
(45) **Date of Patent: *Jun. 12, 2001**

(54) TONER CONTAINER CAP, TONER CONTAINER, AND PROCESS CARTRIDGE

(75) Inventors: Hiroumi Morinaga, Susono; Atsushi Numagami, Mishima; Yasuo Fujiwara, Kashiwa, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 25 days.

(21) Appl. No.: 08/925,620

(22) Filed: Sep. 9, 1997

(30) Foreign Application Priority Data

Sep. 11, 1996 (JP) ..... 8-240439
Sep. 30, 1996 (JP) ..... 8-259803

(51) Int. Cl.[7] ..... G03G 15/08
(52) U.S. Cl. ..... 399/106; 399/111; 399/119
(58) Field of Search ..... 399/102, 103, 399/105, 106, 107, 109, 111, 119, 258, 262, 120

(56) References Cited

U.S. PATENT DOCUMENTS 5,028,966 * 7/1991 Kozuka et al. ..... 399/119 X
5,110,646 5/1992 Prestel et al. .
5,185,616 2/1993 Wilcke .
5,392,963 * 2/1995 Kelly et al. ..... 399/262 X
5,434,656 * 7/1995 Nagaoka et al. ..... 399/106
5,500,714 3/1996 Yashiro et al. .
5,517,285 * 5/1996 Nomura et al. ..... 399/120
5,526,099 * 6/1996 Katakabe ..... 399/258
5,585,895 12/1996 Yashiro et al. .
5,689,774 11/1997 Shishido et al. .
5,815,644 9/1998 Nishiuwatoko et al. ..... 399/113

FOREIGN PATENT DOCUMENTS 0 708 387 4/1996 (EP) .
95-29872 11/1995 (KR) .

OTHER PUBLICATIONS

Patent Abstracts of Japan, JP05 323696, Dec. 7, 1993.
Patent Abstracts of Japan, JP06 214460, Aug. 5, 1994.
Patent Abstracts of Japan, JP06 208301, Jul, 26, 1994.
Patent Abstracts of Japan, JP08 062964, Mar. 8, 1996.
Patent Abstracts of Japan, JP08 220857, Aug. 30, 1996.

* cited by examiner

*Primary Examiner*—Sandra Brase
(74) *Attorney, Agent, or Firm*—Fitzpatrick, Cella, Harper & Scinto

(57) ABSTRACT

A toner accommodation container includes a toner containing portion for containing toner; a toner filling opening, formed in a side surface of said toner containing portion, for filling the toner into said toner containing portion; wherein said filling opening has a non-circular configuration substantially corresponding to a configuration of the side surface.

91 Claims, 20 Drawing Sheets

TONER CONTAINER CAP, TONER CONTAINER, AND PROCESS CARTRIDGE

FIELD OF THE INVENTION AND RELATED ART

The present invention relates to a toner container cap, a toner container, and a process cartridge.

Here, the term process cartridge means refers to a cartridge having as a unit an electrophotographic photosensitive member, and charging means, developing means and cleaning means, which is detachably mountable to a main assembly of an electrophotographic image forming apparatus. It may include as a unit an electrophotographic photosensitive member and at least one of charging means, developing means and cleaning means. It may include as a unit, developing means and an electrophotographic photosensitive member.

And, the electrophotographic image forming apparatus forms an image on a recording material using an electrophotographic image formation process. Examples of electrophotographic image forming apparatus include an electrophotographic copying machine, an electrophotographic printer (laser beam printer, LED printer or the like), a facsimile machine and a word processor or the like.

An electrophotographic image forming apparatus using an electrophotographic process is known which is used with the process cartridge. This is advantageous in that the maintenance operation can be, in effect, carried out by the users thereof without expert service persons, and therefore, operativity can be remarkably improved. Therefore, this type is now widely used.

In an electrophotographic image forming apparatus, a latent image formed on an electrophotographic photosensitive member is developed with the use of developer (hereinafter, "toner"). Since toner is consumed through an image forming process, it must be replenished as needed. For the replenishment of toner, a toner storing container (hereinafter, "toner container") is used. A toner container can be used to replenish a copying machine or the like, as well as the aforementioned process cartridge, with toner, through a simple action.

A toner container is provided with a toner filling opening which is sealed with a toner container cap (hereinafter, "container cap"). Generally, a container cap is formed of low density polyethylene (hereinafter, "LDPE") by injection molding. It comprises several ribs which extend between the sealing walls of the container cap and the center portion of the container cap, to reinforce the sealing walls which seal the toner container as they come in contact with the brim portion of the toner filling opening of the toner container.

SUMMARY OF THE INVENTION

A primary object of the present invention is to provide a toner container cap capable of securely sealing a toner filling opening, a toner container which employs such a toner container cap, and a process cartridge which employs such a toner container.

Another object of the present invention is to provide a toner container cap which is not liable to accidentally be dislodged from the toner filling opening of a toner container, a toner container which employs such a toner container cap, and a process cartridge which employs such a toner container.

Another object of the present invention is to provide a toner container cap which makes it possible to provide one of the side walls of a toner container with such a toner filling opening that has an effective opening area which is larger than, or at least as large as, the largest effective opening area which can be creased using the conventional circular configuration, and which can improve efficiency in toner filling.

Another object of the present invention is to provide a noncircular toner container cap which corresponds to the configuration of the side wall of a toner container, a toner container which employs such a toner container cap, and a process cartridge which employs such a toner container.

Another object of the present invention is to provide a toner cap which has a groove on the exterior side of the side walls thereof which come in contact with the edge of the toner filling opening of a toner container, a toner container which employs such a toner container cap, and a process cartridge which employs such a toner container.

Another object of the present invention is to provide: a noncircular toner container cap, the configuration of which corresponds to the configuration of the side wall of a toner container which has a toner filling opening on one of the side walls thereof, so that the effective opening area of the toner filling opening is increased; a toner container which employs such a toner container cap; and a process cartridge which employs such a toner container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of a toner container cap and a toner container in accordance with the present invention, and comparative embodiments thereof, will be described in detail with reference to the drawings.

Embodiment 1

The first embodiment of the toner container in accordance with the present invention will be described with reference to FIGS. 1 and 2.

Figure 1:
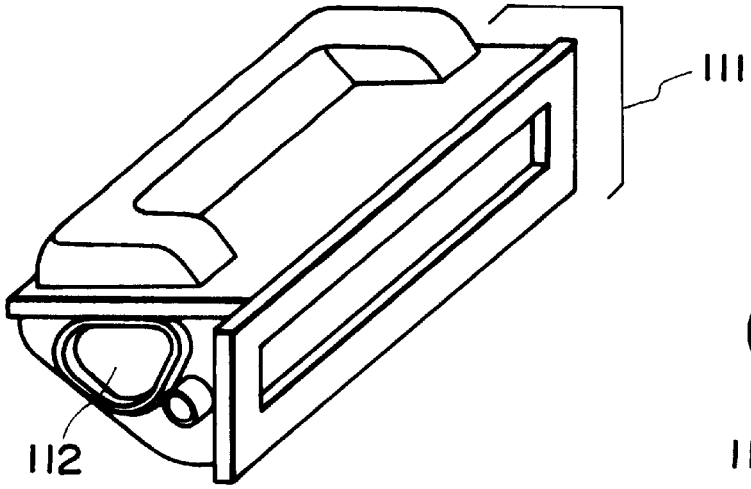
FIG. 1 is a perspective view of the main structure of the toner container in the first embodiment of the present invention.
Figure 2:
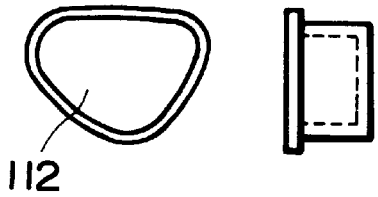
FIG. 2 presents front and side views of the cap for the toner filling opening in the first embodiment of the present invention.

As is evident from FIGS. 1 and 2, the toner container in this embodiment has a toner filling opening 12 in one of the side walls of the main structure 11, and this opening 12 is sealed with a cap 13, which has substantially the same configuration as that of the opening 12, and is pressed into the opening 11.

The contour of the opening 12 is noncircular; it forms a compound curvature composed of a combination of various arcs, and naturally, the external contour of the cap 13 forms substantially the same compound curvature.

The toner container in this embodiment, as well as the toner containers in the rest of the embodiments and comparative embodiments, are formed of highly impact resistant polystyrene by injection molding.

Further, the toner filling opening caps in the following embodiments and comparative embodiments are formed of low density polyethylene or polypropylene by injection molding. However, polypropylene is more desirable as the cap material than low density polyethylene. This is because the stress, which occurs when a cap is pressed into the toner filling opening of a toner container to seal the toner filling opening, is liable to act more on the edge of the toner filling opening than on the cap, and also, because, in the case of a noncircular cap, more attention must be paid to the balance (distribution) of the stress which acts on the cap, than in the case of a circular cap.

The capacity of the actual container portion 11, that is, the main structure of the toner container, in this embodiment, excluding the toner filling opening portion, is 691 cc. The capacities of the actual container portions 11 in the rest of the embodiments and the comparative embodiments are the same as the capacity of the actual container portion 11 in this embodiment.

Embodiment 2

Next, referring to FIGS. 3 and 4, different embodiments of the toner container in accordance with the present invention will be described.

The toner container in this embodiment has substantially the same structure as that described in the preceding embodiment, and therefore, only the different portions will be described.

Figure 3:
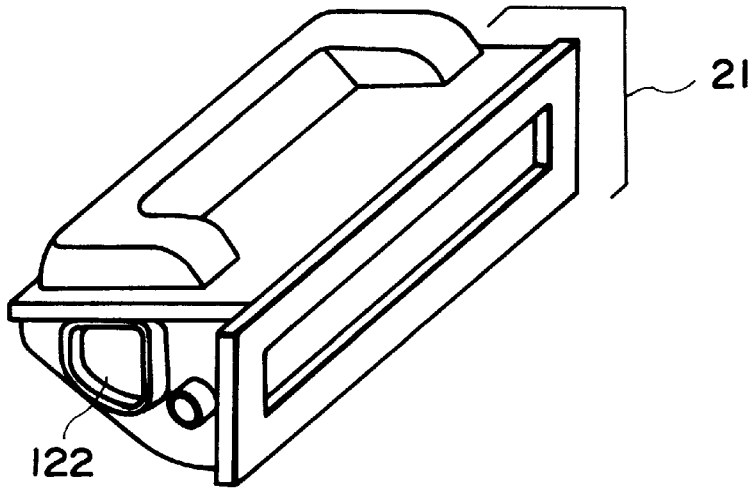
FIG. 3 is a perspective view of the main structure of the toner container in the second embodiment of the present invention.
Figure 4:
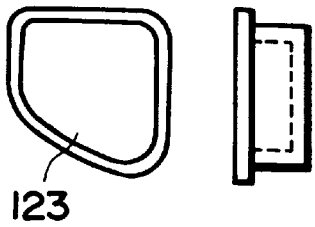
FIG. 4 presents front and side views of the cap for the toner filling opening in the second embodiment of the present invention.

As is evident from FIGS. 3 and 4, the contour of the toner filling opening 22 in this embodiment is formed of a combination of straight lines, and arcs which connect the straight lines; in other words, it is substantially polygonal, and a cap 33 is also substantially polygonal.

Embodiment 3

Next, referring to FIGS. 5 and 6, the third embodiment of the toner container in accordance with the present invention will be described.

The third embodiment is substantially the same as the first and second embodiments, and therefore, only the different portions will be described.

Figure 5:
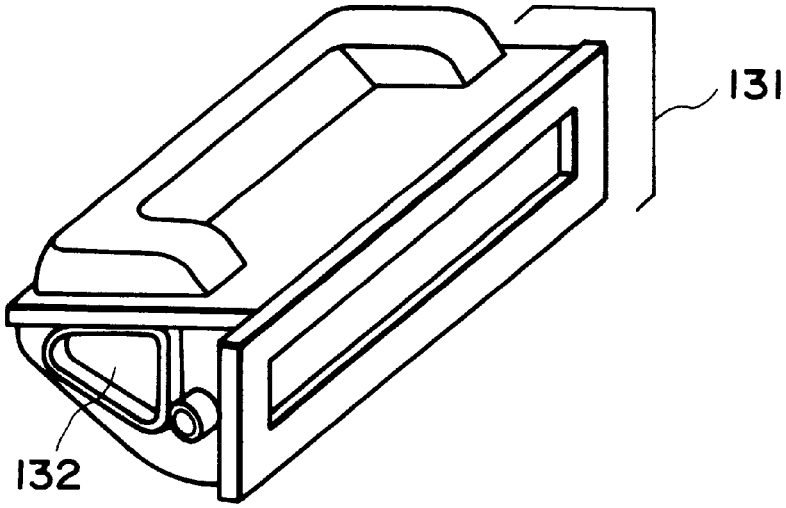
FIG. 5 is a perspective view of the main structure of the toner container in the third and fourth embodiments of the present invention.
Figure 6:
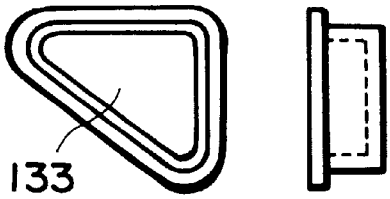
FIG. 6 presents front and side views of the cap for the toner filling opening in the third embodiment of the present invention.

As illustrated in FIGS. 5 and 6, a toner filling opening 32 is substantially triangular, with the apex portions being rounded, and the contour of a cap 33 is substantially the same as that of the opening 32.

Embodiment 4

Next, referring to FIGS. 5 and 7, the fourth embodiment of the toner container in accordance with the present invention will be described. The toner filling opening of the toner container in this embodiment is the same as the toner filling opening 32 in the third embodiment, and therefore, only the different portions will be described.

Figure 7:
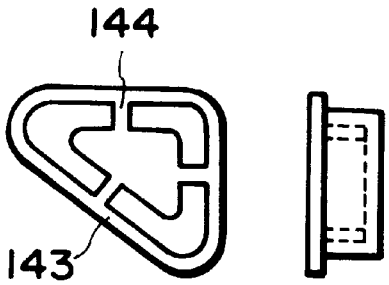
FIG. 7 presents front and side views of the cap for the toner filling opening in the fourth embodiment of the present invention.

Referring to FIG. 7, the toner container in this embodiment is sealed by pressing a cap 43, which is substantially the same in configuration as the toner filling opening 32 in the third embodiment, into a toner filling opening. The cap 43 is provided with ribs 44, each of which is perpendicularly extended inward from the corresponding side wall of the cap 43.

In the above first to fourth embodiments, the effective areas of the toner filling openings 12, 22 and 33 are 860 $mm^2$, which is approximately 95% of the effective opening area 907.9 $mm^2$ of a conventional circular toner filling opening 34 prior to the present invention; in other words, it is substantially the same as the effective opening area of the circular toner filling opening 34 prior to the present invention. As far as the container main structures 11, 21 and 31 are concerned, they are the same in measurement and configuration, except for the toner filling opening portions.

Comparative Embodiment 1

Figure 8:
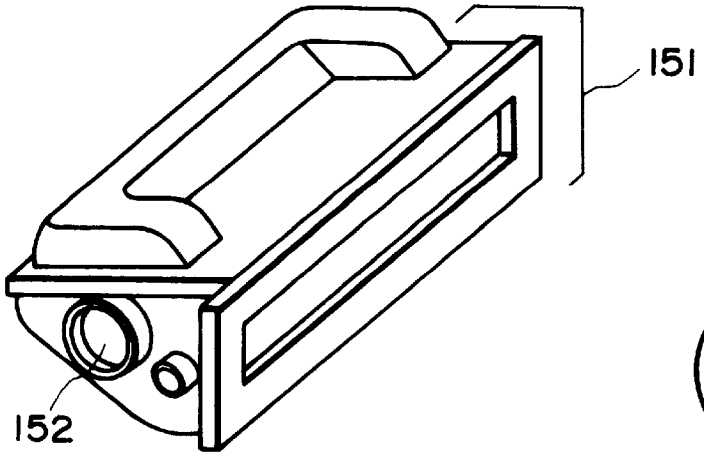
FIG. 8 is a perspective view of the main structure of the toner container in a comparative embodiment.

Next, referring to FIGS. 8 and 9, the toner container in the first comparative embodiment will be described. The descriptions of the portions of the toner container main structure in this comparative embodiment, which are the same as those in the first, second and third embodiments, will be omitted.

Figure 9:
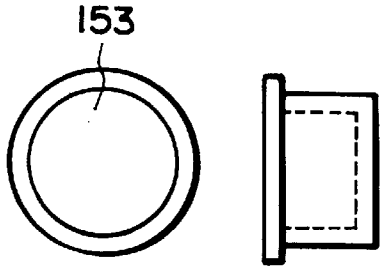
FIG. 9 presents front and side view of the cap for the toner filling opening of the comparative toner container.

As illustrated in FIGS. 3 and 9, the toner filling opening 52 in this embodiment is a circular opening, that is, a modified version of the toner filling opening portion of the container main structure 11, 21 and 31 in the first, second, third, or fourth embodiment, in terms of measurement and configuration.

Even though an attempt was made to increase the effective area of the toner filling opening 52, a diameter of 25 mm was the largest possible; an effective area of 490.9 $mm^2$ was the largest.

The container main structure 51 in this first comparative embodiment is the same as the container main structures 11, 21 and 31 in the first, second and third embodiments in measurement and configuration, except for the toner filling opening portions.

[Toner Filling Speed Test]

Figure 10:
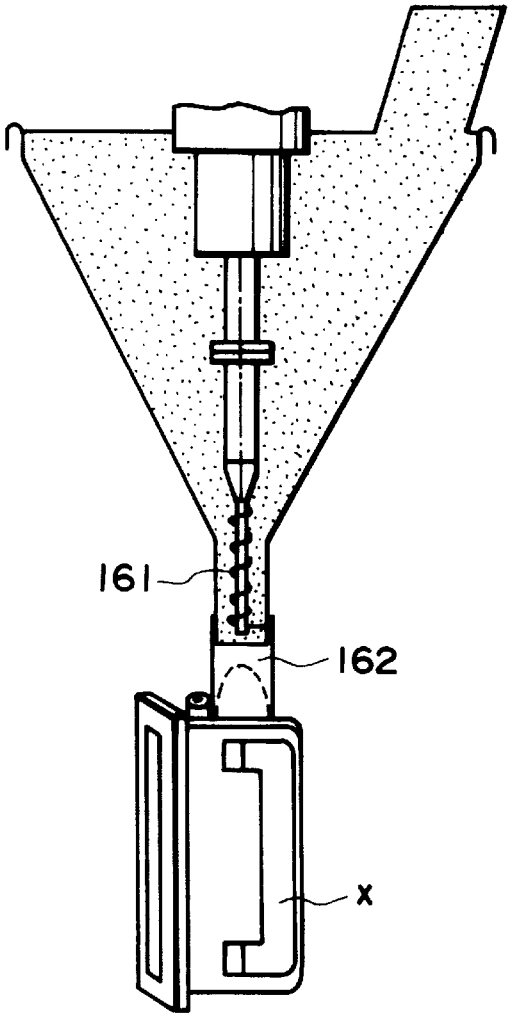
FIG. 10 is a schematic drawing which depicts a toner container, and an auger-type toner filling apparatus which is used for toner filling tests.

Toner was actually filled into each toner container described in the preceding embodiments. As for means to fill a toner container with toner, an auger type filling apparatus (FIG. 10) was employed. The specifications of the auger are as follows.

[Filling Condition 1]

Screw revolution: 800 rpm

Set pulse: 160,000 pulse

External diameter of screw: 28 mm

Screw pitch: 32 mm

Diameter of screw shaft: 8 mm

Internal diameter of filler nozzle: 30 mm

[Filling Condition 2]

Screw revolution: 400 rpm

* Remaining specifications are the same as those in the first condition.

The toner used for the filling test was single component toner, having an average diameter of 8.5 $\mu$m. The amount of the filled toner was 380 g. The results of the filling test are given in the following table.

TABLE 1

| | FILLING CONDITIONS | TIMES REQUIRED | EVALUATION |
|---|---|---|---|
| EMB. 1 | 1 | 3.6 sec. | NO PROBLEM |
| EMB. 2 | 1 | 3.6 sec. | NO PROBLEM |
| EMB. 3 | 1 | 3.6 sec. | NO PROBLEM |
| COMP. EMB. 1 | 1 | NOT POSSIBLE | NOZZLE WAS CLOGGED; TONER WAS FUSED |
| COMP. EMB. 2 | 2 | 7.2 sec. | SLOW SPEED (DOUBLE) |

As is evident from the table, there was no problem in the cases of the first to third embodiments, and the time it took to fill each container was 3.6 seconds. These results are substantially the same as those for a conventional circular toner filling opening. Further, it was examined whether or not the filler nozzle was clogged adjacent to the toner filling opening, whether or not coarse particles were created, or whether or not the like problems occurred, but no specific problem could be confirmed.

On the contrary, in the cases of the first and second comparative embodiments, clogging occurred to the filler nozzle of the toner filing apparatus, causing the toner particles to fuse, under Filling Condition 1 under which the auger revolution was 800 rpm. Therefore, the auger revolution was gradually dropped in decrements of several revolutions from 800 rpm to confirm the number of revolution at which no clogging occurred. The confirmed result was that toner could be filled at 400 rpm without clogging the nozzle. Then, in order to confirm this finding, another toner filling test was conducted using Filling Condition 2 in which the auger revolution was 400 rpm. In this case, filling took 7.2 seconds, which is twice the filling time for the embodiments of the present invention, which is not satisfactory.

[Drop Test]

In this test, the toner containers described in the first to fourth embodiments were dropped to test whether or not the cap of any of the toner containers became loose, or whether or not toner leaked from any of the toner containers.

Dropping Conditions

First, each container was dropped from a height of 90 cm, and then, the height was gradually increased when the preceding drop did not cause any problem. Each container was test by dropping it once on the corner, three times on the edge, and six times on the wall surface.

State of Packaging

Five toner containers were tested for each embodiment, wherein each container was individually packaged.

The result was that the loosening of the cap, and toner leak, did not occur in any of the toner containers in the first to fourth embodiments.

Further, when the toner containers were dropped from a height of 110 cm, toner leak occurred in the toner containers in the first to third embodiments, at the joint between the toner container cap and the edge of the toner filling opening, but the amount of the toner leak was small enough to create no practical problem. In the case of the toner container in the fourth embodiment, no problem occurred even when it was dropped from the height of 110 cm.

The results of the above described filling and dropping tests prove that the toner containers in the first to fourth embodiments have no practical problem in terms of efficiency in toner filling and effectiveness in toner sealing.

As described above, according to the preceding embodiments, the level of control in terms of cap dimension can be eased when the contour of the toner filling opening of a toner container is rendered polygonal, compared to when it is rendered noncircular without having straight portions.

Further, when the toner filling opening is rendered substantially triangular, the toner filling opening can be expanded into even the narrow corner area of the side wall of the container main structure, and therefore, the effective area of the toner filling opening can be rendered equal to, or larger than, those of the conventional toner filling openings. In other words, the toner filling opening in accordance with the present invention is superior to the conventional round toner filling opening, in terms of efficiency in toner filling.

The above described toner filling opening is sealed by pressing into it a polygonal cap having substantially the same contour as the toner filling opening. Further, the polygonal cap is provided with ribs, each of which perpendicularly projects inward from the corresponding sealing wall of the cap, and therefore, the straight portions of the sealing walls of the polygonal cap are prevented from being bent by the stress which occurs in the straight portions of the sealing walls as the cap is pressed into the toner filling opening. Thus, the toner container cap with the ribs can further improve the level of effectiveness in sealing the toner filling opening.

Further, when the toner containing portion of a process cartridge is structured as the above described toner container, the process cartridge is improved in terms of compactness, efficiency in toner filling, and efficiency in process cartridge manufacture.

As is evident from the preceding embodiments, according to the present invention, the toner filling opening of a toner container corresponds to the configuration of the side wall of a toner container, and therefore, certain portions of the toner container wall, which cannot be utilized when the configuration of a toner filling opening is round as is the configuration of a conventional toner filling opening, can be utilized to improve efficiency in toner filling, and also, effectiveness in sealing the toner container, as well as efficiency in toner container manufacture, can match or exceed those of the toner container with a round toner filling opening.

Next, the embodiments of a process cartridge which employs the above described toner container cap and toner container will be described.

In the following description, the "widthwise" direction of a process cartridge B means the direction in which the process cartridge B is installed into, or removed from, the main assembly of an image forming apparatus, and coincides with the direction in which a recording medium is conveyed. The "lengthwise" direction of the process cartridge B means a direction which is intersectional with (substantially perpendicular to) the direction in which the process cartridge B is installed into, or removed from, the main assembly 14. It is parallel to the surface of the recording medium, and intersectional with (substantially perpendicular to) the direction in which the recording medium is conveyed. Further, the "left" or "right" means the left or right relative to the direction in which the recording medium is conveyed, as seen from above.

Figure 11:
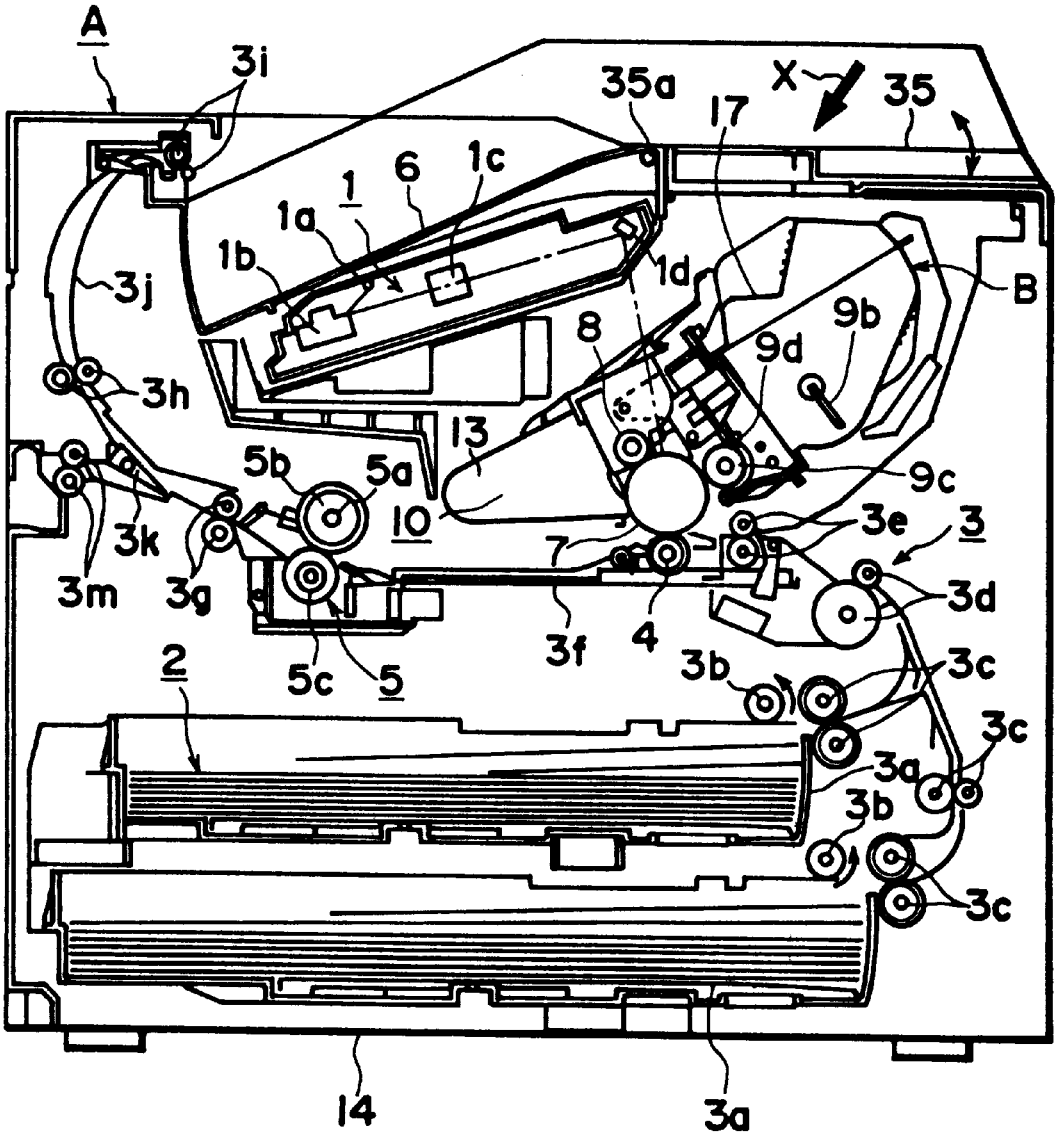
FIG. 11 is a side elevation of an electrophotographic image forming apparatus (laser beam printer) to which the present invention is applicable.
Figure 12:
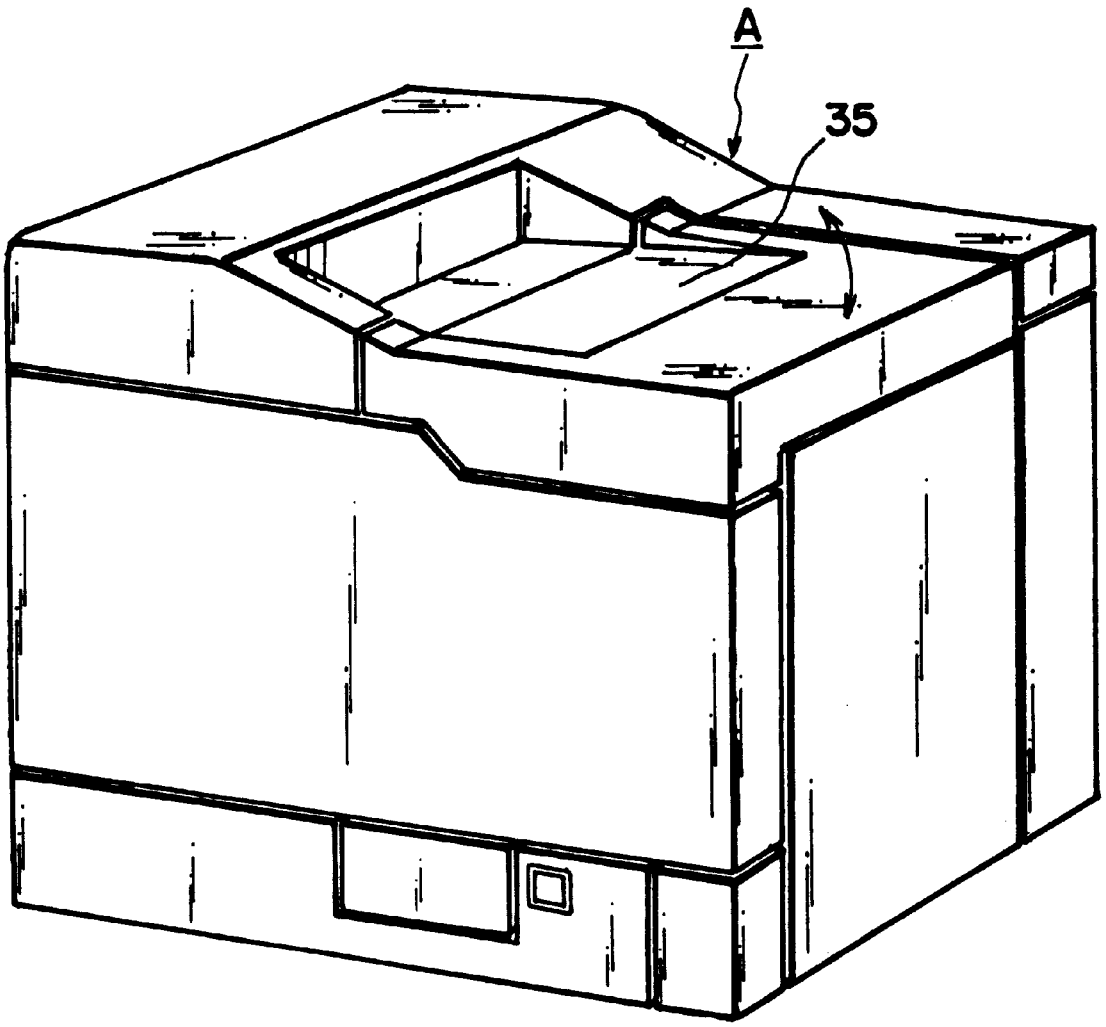
FIG. 12 is an external perspective view of the apparatus illustrated in FIG. 11.
Figure 13:
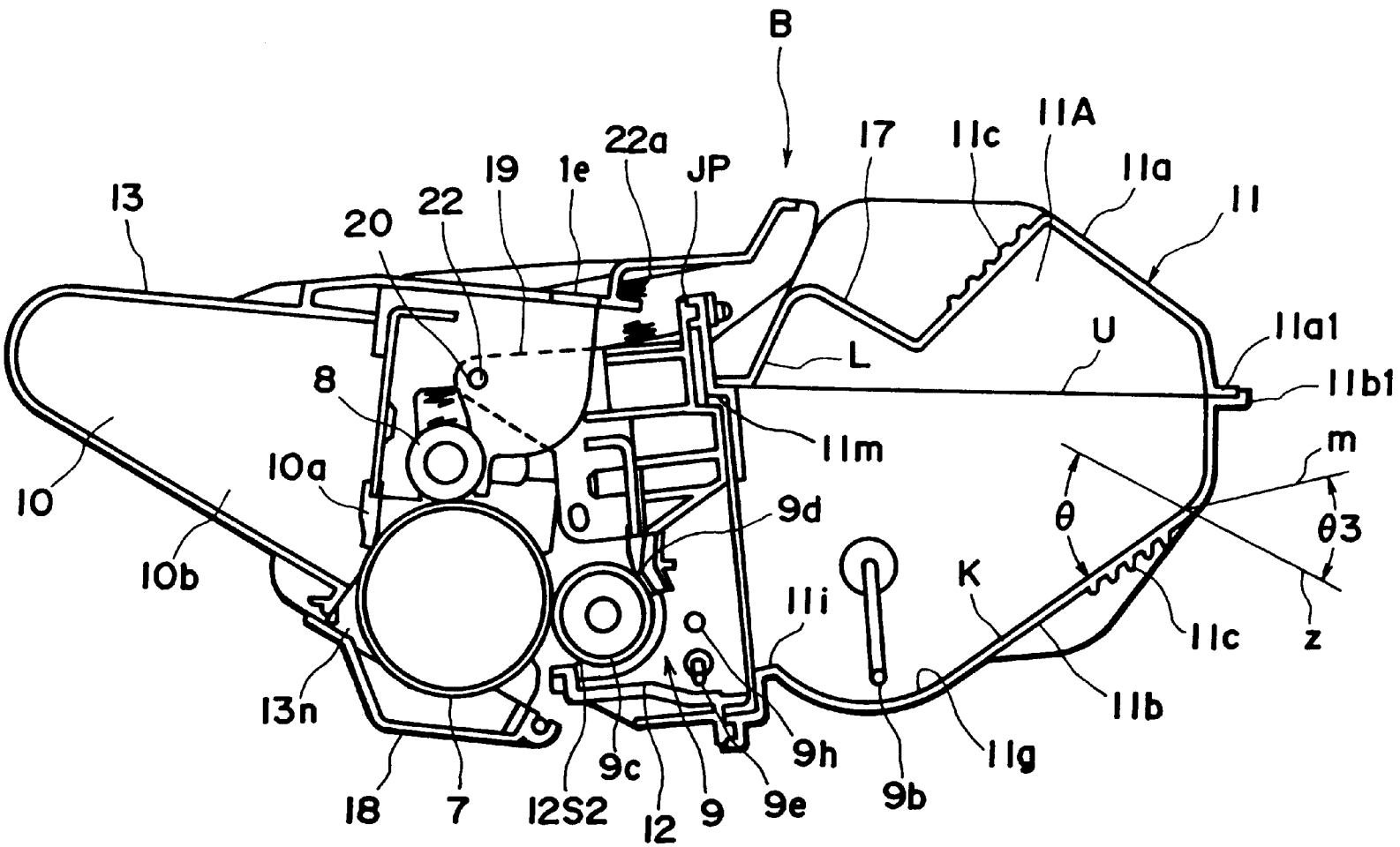
FIG. 13 is a cross-section of a process cartridge usable with the electrophotographic image forming apparatus illustrated in FIG. 11.
Figure 14:
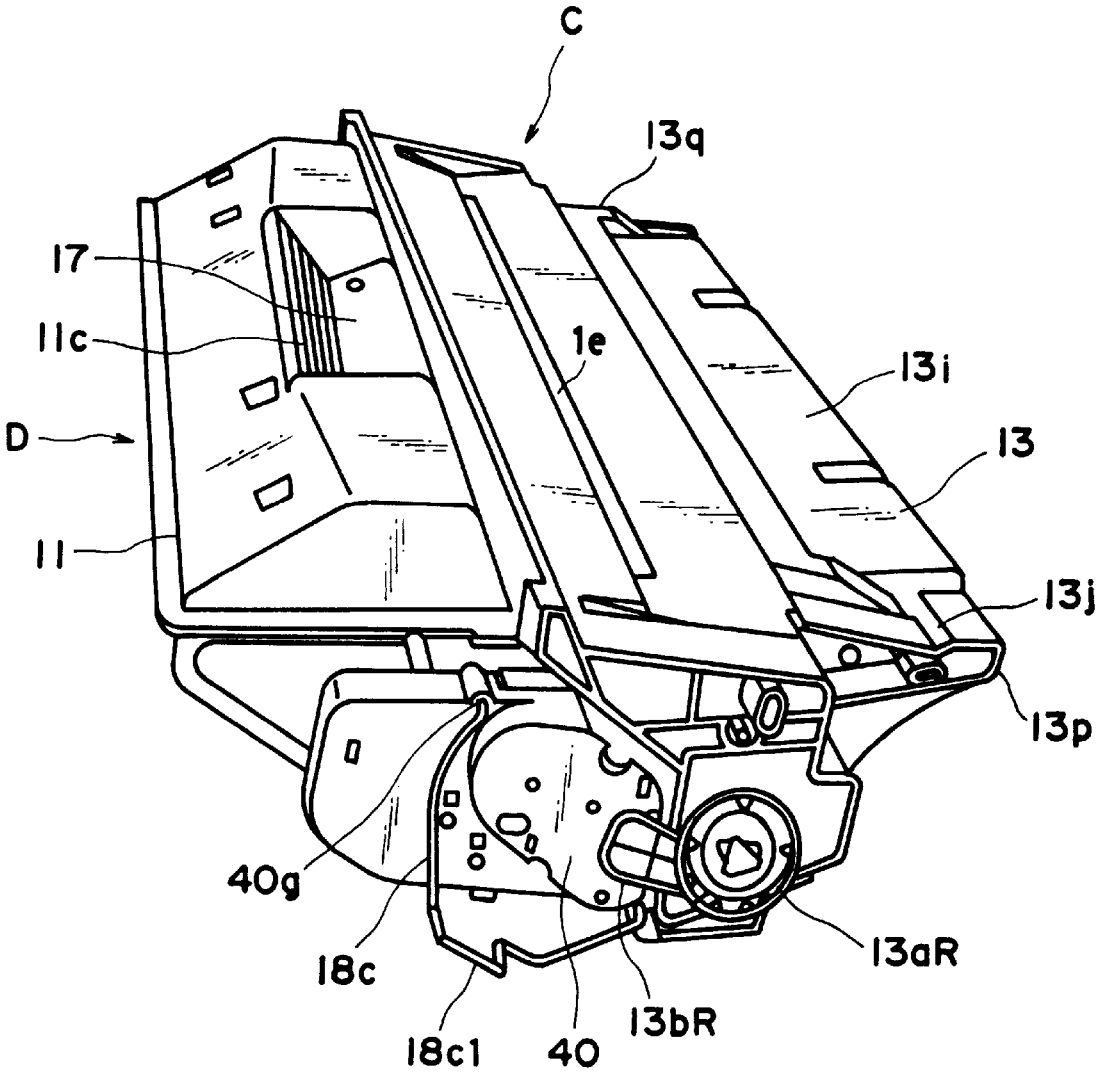
FIG. 14 is an external perspective view of the process cartridge illustrated in FIG. 13.
Figure 15:
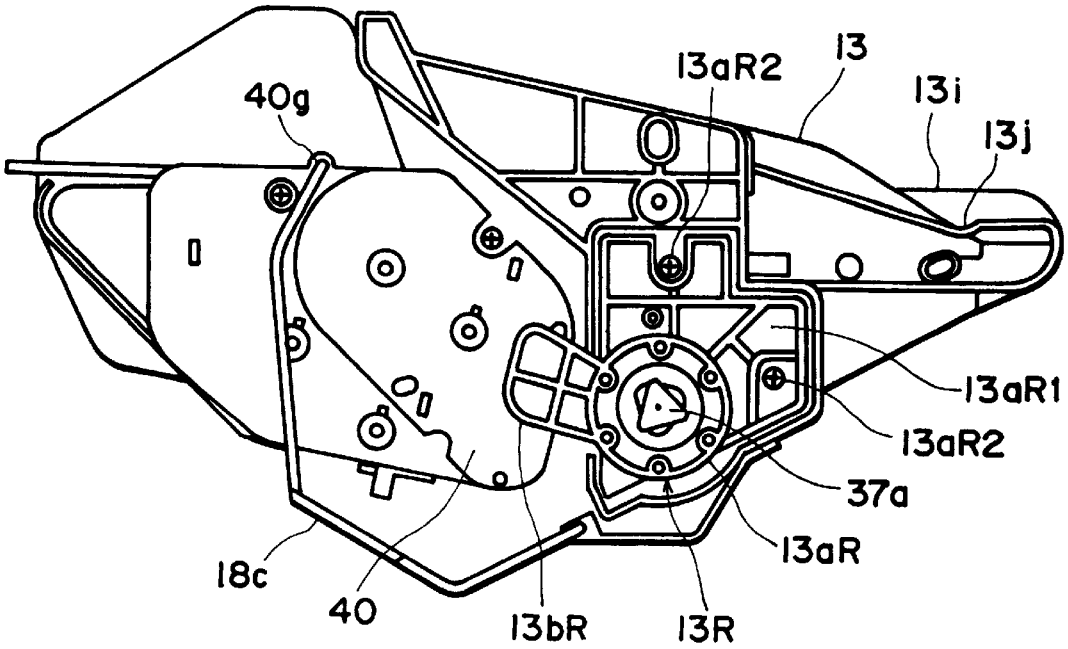
FIG. 15 is a right-hand side view of the process cartridge illustrated in FIG. 13.
Figure 16:
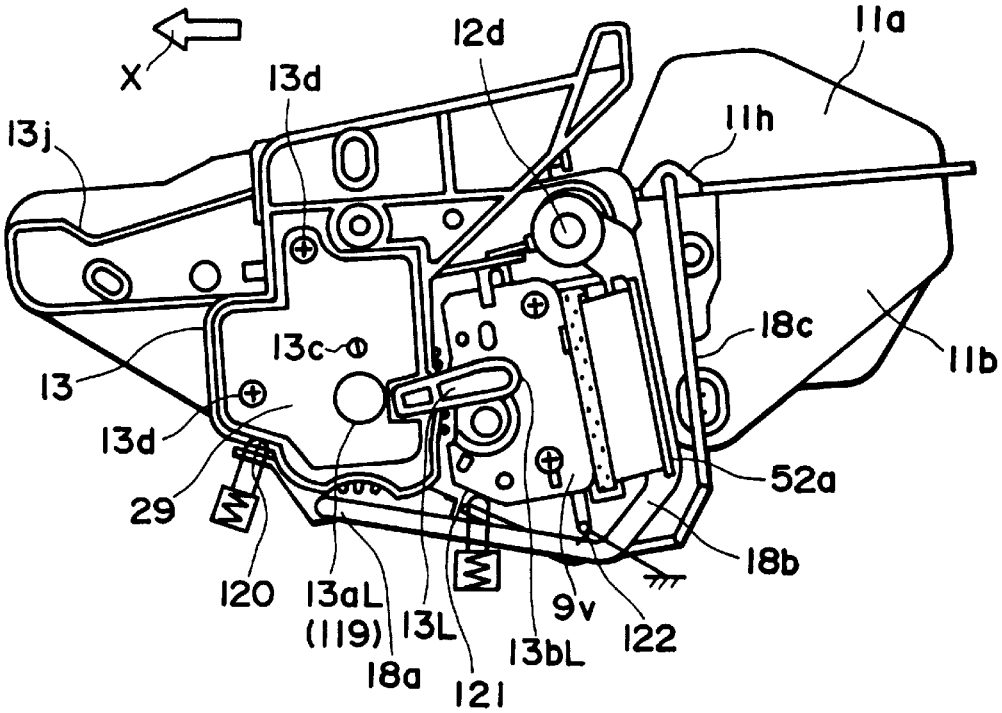
FIG. 16 is a left-hand side view of the process cartridge illustrated in FIG. 13.
Figure 17:
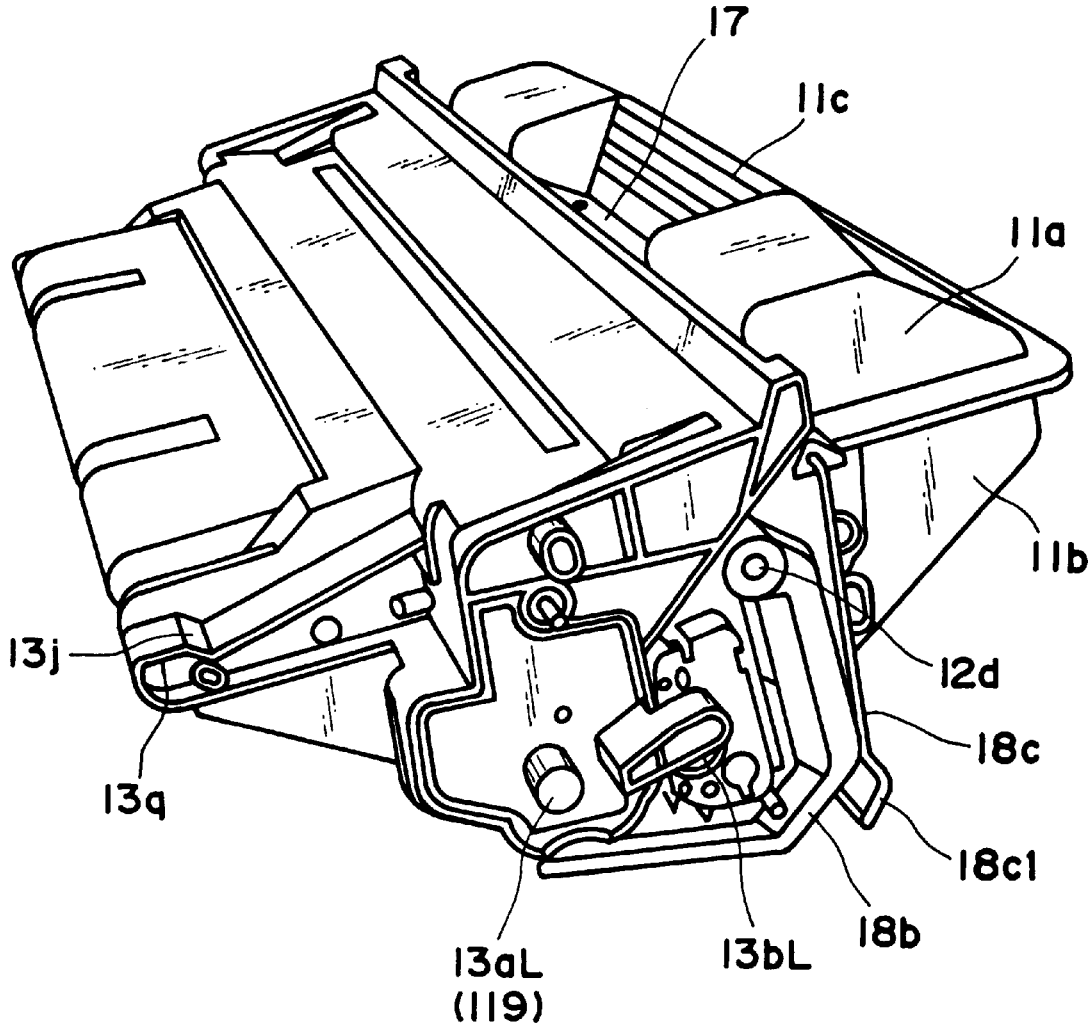
FIG. 17 is an external perspective view of the process cartridge illustrated in FIG. 13, as seen from the left side.
Figure 18:
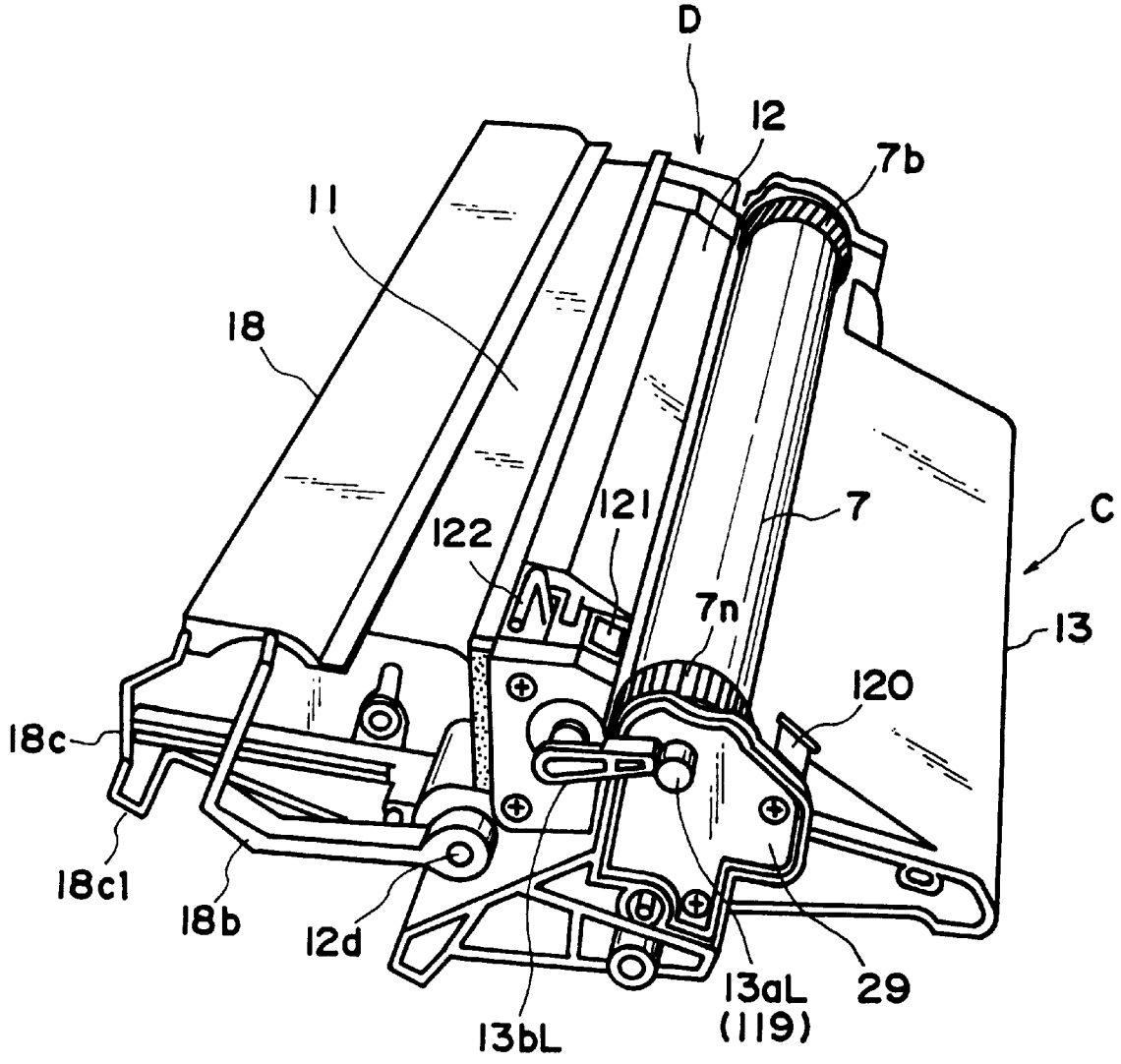
FIG. 18 is an external perspective view of the process cartridge illustrated in FIG. 13, as seen from the bottom right.

FIG. 11 is an electrophotographic image forming apparatus (laser beam printer) which embodies the present invention, depicting the general structure thereof; FIG. 12, an external perspective thereof; and FIGS. 13–18 are drawings of process cartridges which embody the present invention. More specifically, FIG. 13 is a cross-section of a process cartridge; FIG. 14, an external perspective view of the process cartridge; FIG. 15, a right-hand side view of the process cartridge; FIG. 16, a left-hand side view of the process cartridge; FIG. 17, a perspective view of the process cartridge as seen from the top left direction; and FIG. 18 is a perspective view of the process cartridge as seen from the bottom left direction. In the following description, the "top" surface of the process cartridge B means the surface which faces upward when the process cartridge B is in the main assembly 14 of the image forming apparatus, and the "bottom" surface means the surface which faces downward.

(Electrophotographic Image Forming Apparatus A and Process Cartridge B)

First, referring to FIGS. 11 and 12, a laser beam printer A as an electrophotographic image forming apparatus which embodies the present invention will be described. FIG. 13 is a cross-section of a process cartridge which also embodies the present invention.

Referring to FIG. 11, the laser beam printer A is an apparatus which forms an image on a recording medium (for example, recording sheet, OHP sheet, and fabric) through an electrophotographic image forming process. It forms a toner image on an electrophotographic photosensitive drum (hereinafter, photosensitive drum) in the form of a drum. More specifically, the photosensitive drum is charged by the use of a charging means, and a laser beam modulated with the image data of a target image is projected from an optical means onto the charged peripheral surface of the photosensitive drum, forming thereon a latent image in accordance with the image data. This latent image is developed into a toner image by a developing means. Meanwhile, a recording medium 2 placed in a sheet feeding cassette 3*a* is reversed and conveyed by a pickup roller 3*b,* a conveyer roller pairs 3*c* and 3*d,* and register roller pair 3*e,* in synchronism with the toner formation. Then, voltage is applied to an image transferring roller 4 as a means for transferring the toner image formed on the photosensitive drum 7 of the process cartridge B, whereby the toner image is transferred onto the recording medium 2. Thereafter, the recording medium 2, onto which the toner image has been transferred, is conveyed to a fixing means 5 by guiding conveyer 3*f.* The fixing means 5 has a driving roller 5*c,* and a fixing roller 5*b* containing a heater 5*a,* and applies heat and pressure to the recording medium 2 as the recording medium 2 is passed through the fixing means 5, so that the image having been transferred onto the recording medium 2 is fixed to the recording medium 2. Then, the recording medium 2 is conveyed farther, and is discharged into a delivery tray 6 through a reversing path 3*j,* by discharging roller pairs 3*q,* 3*h* and 3*i.* The delivery tray 6 is located at the top of the main assembly 14 of the image forming apparatus A. It should be noted here that a pivotable flapper 3*k* may be operated in coordination with a discharge roller pair 2*m* to discharge the recording medium 2 without passing it through the reversing path 3*j.* The pickup roller 3*b,* the conveyer roller pairs 3*c* and 3*d,* the register roller pair 3*e,* the guiding conveyer 3*f,* the discharge roller pairs 3*g,* 3*h* and 3*i,* and the discharge roller pair 3*m* constitute a conveying means 3.

Referring to FIGS. 13–18, in the process cartridge B, on the other hand, the photosensitive drum 7 with a photosensitive layer 7*e* is rotated to uniformly charge its surface by applying voltage to the charging roller 8 as a photosensitive drum charging means. Then, a laser beam modulated with the image data is projected onto the photosensitive drum 7 from the optical system 1 through an exposure opening 1*e,* forming a latent image on the photosensitive drum 7. The thus formed latent image is developed with the use of toner and the developing means 9. More specifically, the charging roller 8 is disposed in contact with the photosensitive drum 7 to charge the photosensitive drum 7. It is rotated by the rotation of the photosensitive drum 7. The developing means 9 provides the peripheral surface area (area to be developed) of the photosensitive drum 7 with toner so that the latent image formed on the photosensitive drum 7 is developed. The optical system 1 comprises a laser diode 1*a,* a polygon mirror 1*b,* a lens 1*c,* and a deflective mirror 1*d.*

In the developing means 9, the toner contained in a toner container 11A is delivered to a developing roller 9*c* by the rotation of a toner feeding member 9*b.* The developing roller 9*c* contains a stationary magnet. It is also rotated so that a layer of toner with triboelectric charge is formed on the peripheral surface of the developing roller 9*c.* The image developing area of the photosensitive drum 7 is provided with the toner from this toner layer, and the toner is transferred onto the peripheral surface of the photosensitive drum 7 in a manner to reflect the latent image, visualizing the latent image as a toner image. The developing blade 9*d* is a blade which regulates the amount of the toner adhered to the peripheral surface of the developing roller 9*c* and also triboelectrically charges the toner. Adjacent to the developing roller 9*c,* a toner stirring member 9*c* is rotatively disposed to circulatively stir the toner within the image developing chamber.

After the toner image formed on the photosensitive drum 7 is transferred onto the recording medium 2 by applying voltage with polarity opposite to that of the toner image to the image transferring roller 4, the residual toner on the photosensitive drum 7 is removed by the cleaning means 10. The cleaning means 10 comprises an elastic cleaning blade 10*a* disposed in contact with the photosensitive drum 7, and the toner remaining on the photosensitive drum 7 is scraped off by the elastic cleaning blade 10*a,* being collected into a waste toner collector 10*b.*

The process cartridge B is formed in the following manner. First, a toner chamber frame 11 which comprises a toner container (toner storing portion) 11A for storing toner is joined with an image developing chamber frame 12 which houses the image developing means 9 such as an image developing roller 9*c,* and then, a cleaning chamber frame 13, in which the photosensitive drum 7, the cleaning means 10 such as the cleaning blade 10*a,* and the charging roller 8 are mounted, is joined with the preceding two frames 11 and 12 to complete the process cartridge B. The thus formed process cartridge B is removably installable into the main assembly 14 of the image forming apparatus A.

The process cartridge B is provided with an exposure opening through which a light beam modulated with image data is projected onto the photosensitive drum 7, and a transfer opening 13*n* through which the photosensitive drum 7 opposes the recording medium 2. The exposure opening 1*e* is a part of the cleaning chamber frame 11, and the transfer opening 13*n* is located between the image developing chamber frame 12 and the cleaning chamber frame 13.

Next, the structure of the housing of the process cartridge B in this embodiment will be described.

The process cartridge in this embodiment is formed in the following manner. First the toner chamber frame 11 and the image developing chamber frame 12 are joined, and then, the cleaning chamber frame 13 is rotatively joined with the preceding two frames 11 and 12 to complete the housing. In this housing, the aforementioned photosensitive drum 7, charging roller 8, developing means 9, cleaning means 10, and the like, are mounted to complete the process cartridge B. The thus formed process cartridge B is removably installable into the cartridge accommodating means provided in the main assembly 14 of an image forming apparatus.

(Housing Structure of Process Cartridge B)

As described above, the housing of the process cartridge B in this embodiment is formed by joining the toner chamber frame 11, the image developing chamber frame 12, and the cleaning chamber frame 13. Next, the structure of the thus formed housing will be described.

Figure 19:
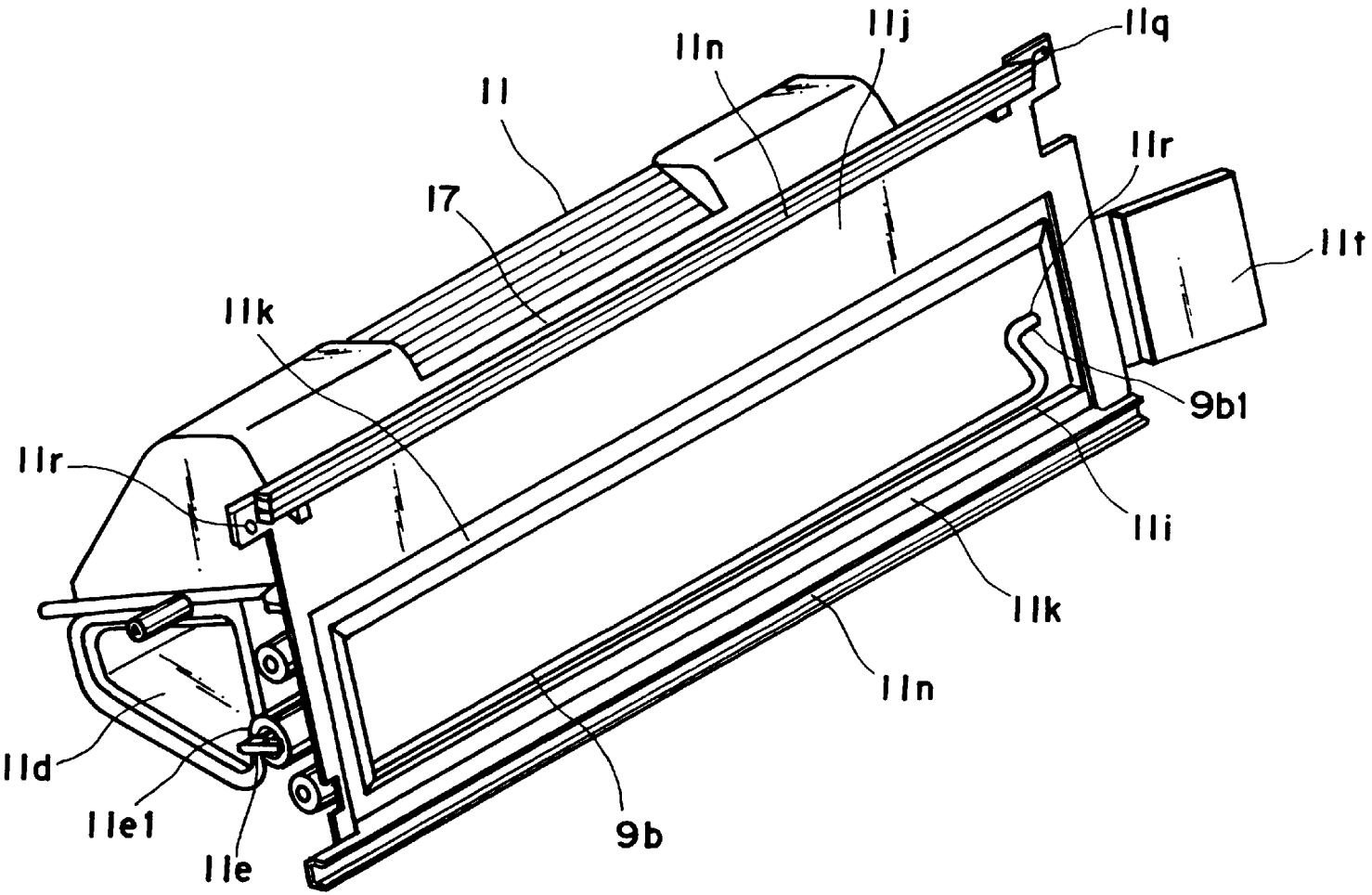
FIG. 19 is a perspective view of the toner container portion of the frame of the process cartridge illustrated in FIG. 13.
Figure 20:
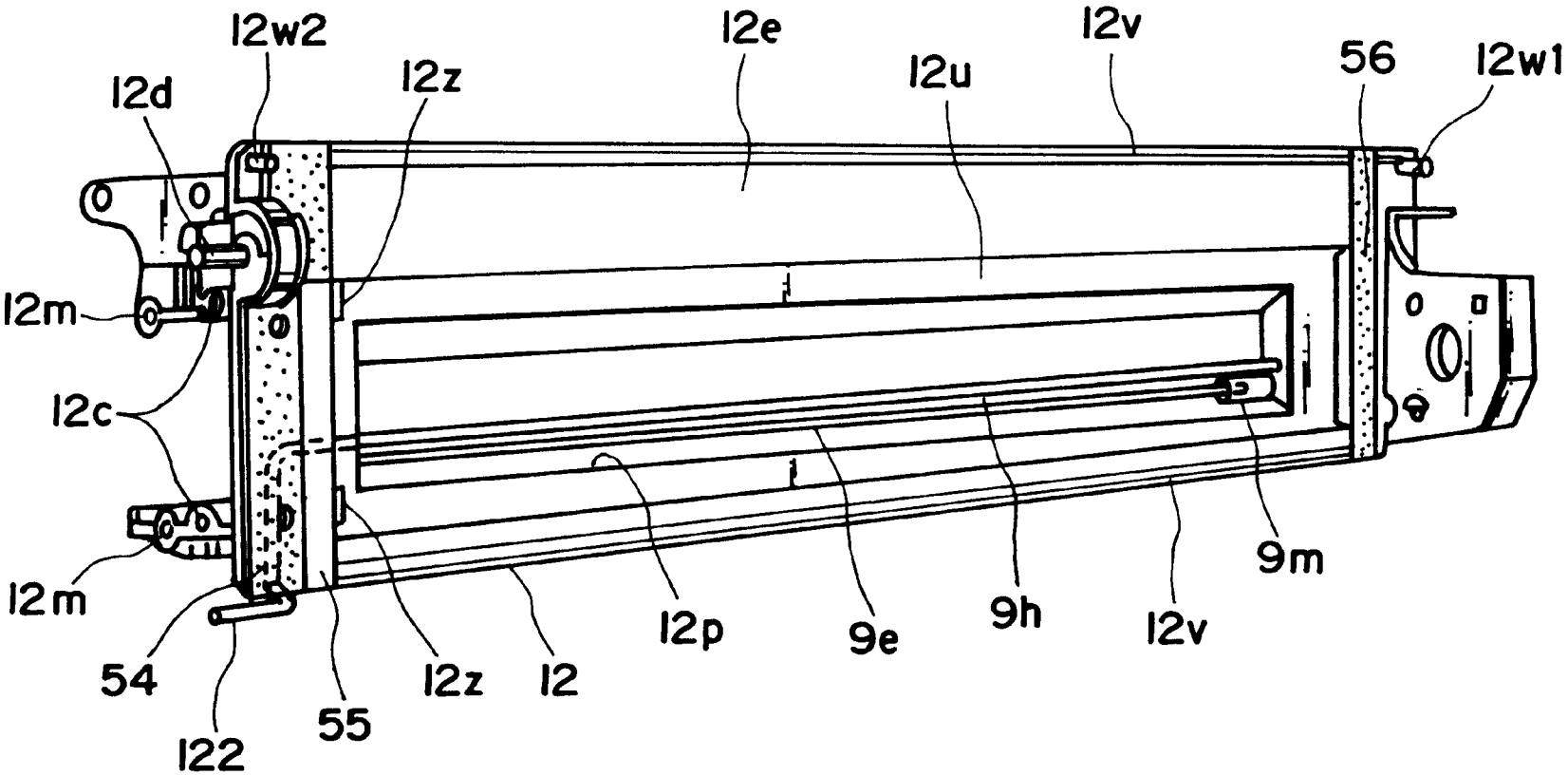
FIG. 20 is a perspective view of the developing station portion of the frame of the process cartridge illustrated in FIG. 13.
Figure 21:
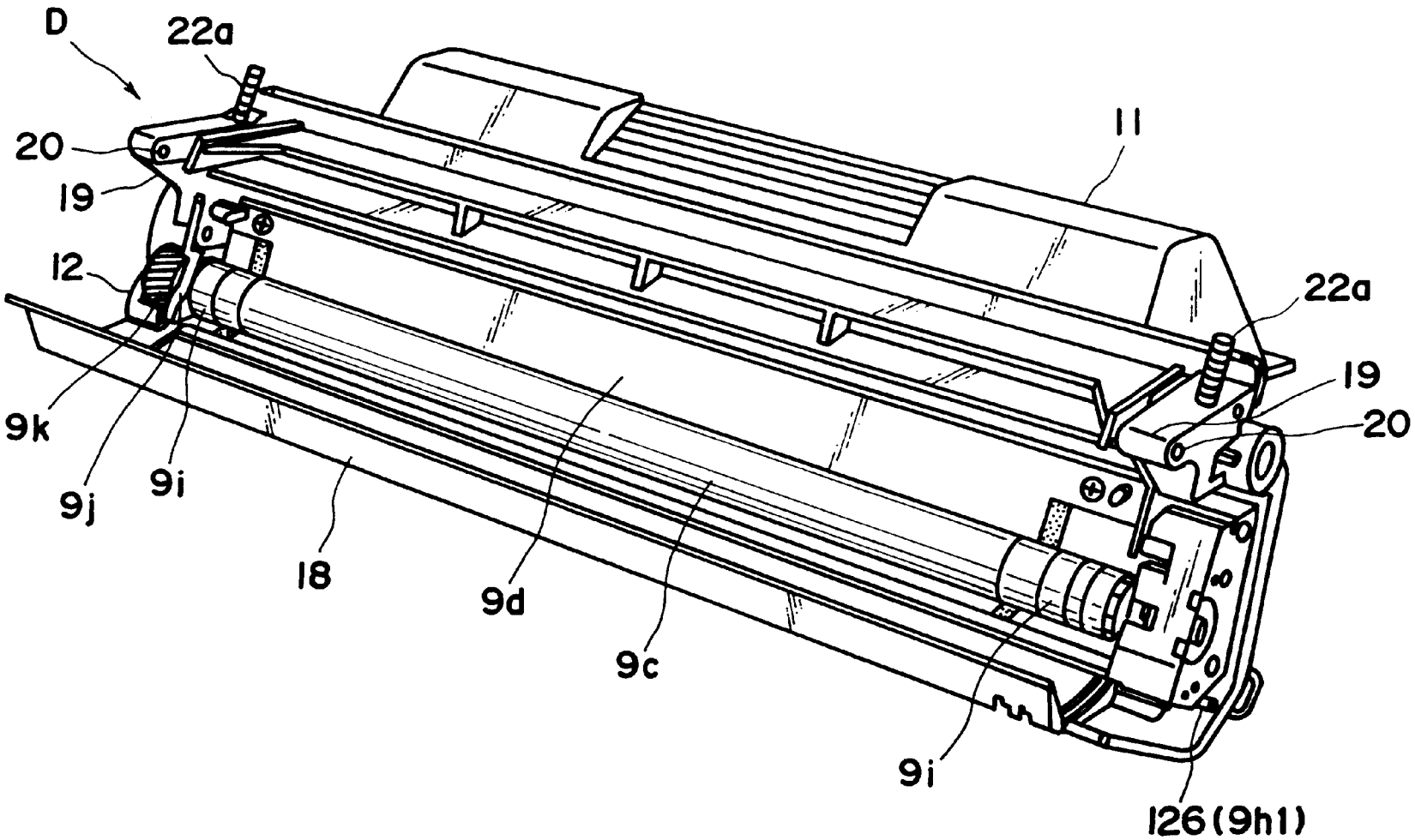
FIG. 21 is a perspective view of the developing unit portion of the process cartridge illustrated in FIG. 13.

Referring to FIGS. 13 and 19, in the toner chamber frame 11, the toner feeding member 9*b* is rotatively mounted. In the image developing chamber frame 12, the image developing roller 9*c* and the developing blade 9*d* are mounted, and adjacent to the developing roller 9*c,* the stirring member 9*c* is rotatively mounted to circulatively stir the toner within the image developing chamber. Referring to FIGS. 13 and 20, in the image developing chamber frame 12, a rod antenna 9*h* is mounted, extending in the lengthwise direction of the developing roller 9*c* substantially in parallel to the developing roller 9*c.* The toner chamber frame 11 and the development chamber frame 12, which are equipped in the above-described manner, are welded together (in this embodiment, by ultrasonic wave) to form a second frame which constitutes an image developing unit D (FIG. 21).

The image developing unit of the process cartridge B is provided with a drum shutter assembly 18, which covers the photosensitive drum 7 to prevent it from being exposed to light for an extended period of time or from coming in contact with foreign objects when or after the process cartridge B is removed from the main assembly 14 of an image forming apparatus.

Referring to FIG. 16, the drum shutter assembly 18 has a shutter cover 18*a* which covers or exposes the transfer opening 13*n* illustrated in FIG. 13, and linking members 18*b* and 18*c* which support the shutter cover 18. On the upstream side relative to the direction in which the recording medium 2 is conveyed, one end of the right-hand side linking member 18*c* is fitted in a hole 40*g* of a developing means gear holder 40 as shown in FIGS. 14 and 15, and one end of the left-hand side linking member 18*c* is fitted in a boss 11*h* of the bottom portion 11*b* of the toner chamber frame 11. The other ends of the left- and right-hand linking members 18*c* are attached to the corresponding lengthwise ends of the shutter cover 18*a,* on the upstream side relative to the recording medium conveying direction. The linking member 18*c* is made of a metallic rod. Actually, the left- and right-hand linking members 18*c* are connected through the shutter cover 18*a;* in other words, the left- and right-hand linking members 18*c* are the left- and right-hand ends of a single piece linking member 18*c.* The linking member 18*b* is provided only on one lengthwise end of the shutter cover 18*a.* One end of the linking member 18*b* is attached to the shutter cover 18*a,* on the downstream side, relative to the recording medium conveying direction, of the position at which the linking member 18*c* is attached to the shutter cover 18*a,* and the other end of the linking member 18*b* is fitted around a dowel 12*d* of the image development chamber frame 12. The linking member 18*b* is formed of synthetic resin.

The linking members 18*b* and 18*c,* which are different in length, form a four piece linkage structure in conjunction with the shutter cover 18*a* and the toner chamber frame 11. As the process cartridge B is inserted into an image forming apparatus, the portion 18*c*1 of the linking member 18*c,* which projects away from the process cartridge B, comes in contact with the stationary contact member (unillustrated) provided on the lateral wall of the cartridge accommodating space S of the mains assembly 14 of the image forming apparatus, and activates the drum shutter assembly 18 to open the shutter cover 18*a.*

The drum shutter assembly 18, constituted of the shutter cover 18*a* and the linking members 18*b* and 18*c,* is loaded with the pressure from an unillustrated torsional coil spring fitted around a dowel 12*d.* One end of the spring is anchored to the linking member 18*b,* and the other end is anchored to the image developing chamber frame 12, so that pressure is generated in a direction to cause the shutter cover 18*a* to cover the transfer opening 13*n.*

Referring again to FIGS. 13 and 22, the cleaning means frame 13 is fitted with the photosensitive drum 7, the charging roller 8, and the various components of the cleaning means 10, to form a first frame as a cleaning unit C (FIG. 22).

Figure 22:
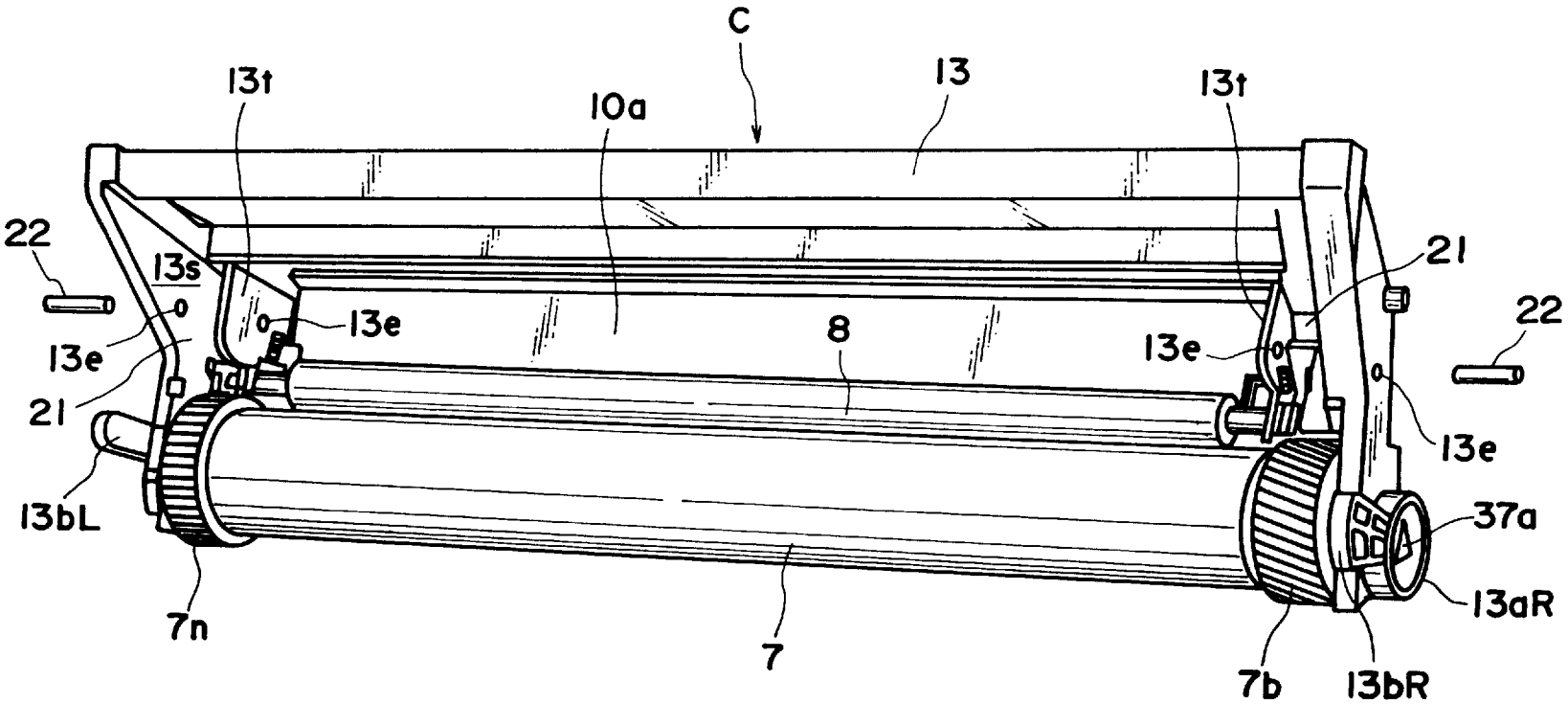
FIG. 22 is a perspective view of the cleaning unit portion of the process cartridge illustrated in FIG. 13.

Then, the aforementioned image developing unit D and cleaning unit C are joined by the use of a joining member 22, in a mutually pivotable manner, to complete the process cartridge B. More specifically, referring to FIG. 21, both lengthwise (axial direction of the developing roller 9*c*) ends of the image developing chamber frame 12 are provided with an arm portion 19, which is provided with a round hole 20 which is parallel to the developing roller 9*c*. On the other hand, a recessed portion 21 for accommodating the arm portion 19 is provided at each lengthwise end of the cleaning chamber frame (FIG. 22). The arm portion 19 is inserted in this recessed portion 21, and the joining member 22 is pressed into the mounting hole 13*e* of the cleaning chamber frame 13, put through the hole 20 of the end portion of the arm portion 19, and pressed, farther, into the hole 13*e* of an partitioning wall 13*t*, so that the image developing unit D and the cleaning unit C are joined to be pivotable relative to each other about the joining member 22. In joining the image developing unit D and the cleaning unit C, a compression type coil spring 22*a* is placed between the two units, with one end of the coil spring being fitted around an unillustrated dowel erected from the base portion of the arm portion 19, and the other end being pressed against the top wall of the recessed portion 21 of the cleaning chamber frame 13. As a result, the image developing chamber frame 12 is pressed downward to reliably keep the developing roller 9*c* pressed downward toward the photosensitive drum 7. More specifically, referring to FIG. 21, a roller 9*i* having a diameter larger than that of the developing roller 9*c* is attached to each lengthwise end of the developing roller 9*c*, and this roller 9*i* is pressed on the photosensitive drum 7 to maintain a predetermined gap (approximately 300 μm) between the photosensitive drum 7 and the developing roller 9*c*. The top surface of the recessed portion 21 of the cleaning chamber frame 13 is slanted so that the compression type coil spring 22*a* is gradually compressed when the image developing unit D and the cleaning unit C are united. That is, the image developing unit D and the cleaning unit C are pivotable toward each other about the joining member 22, wherein the positional relationship (gap) between the peripheral surface of the photosensitive drum 7 and the peripheral surface of the developing roller 9*c* is precisely maintained by the elastic force of the compression type coil spring 22*a*.

Since the compression type coil spring 22*a* is attached to the base portion of the arm portion 19 of the image developing chamber frame 12, the elastic force of the compression type coil spring 22*a* affects nothing but the base portion of the arm portion 19. In a case in which the image developing chamber frame 12 is provided with a dedicated spring mount for the compression type coil spring 22*a*, the adjacent areas of the spring seat must be reinforced to precisely maintain the predetermined gap between the photosensitive drum 7 and the developing roller 9*c*. However, with the placement of the compression type coil spring 22*a* in the above described manner, it is unnecessary to reinforce the adjacent areas of the spring seat, that is, the adjacent areas of the base portion of the arm portion 19 in the case of this embodiment, because the base portion of the arm portion 19 is inherently greater in strength and rigidity.

(Toner Chamber Frame)

Figure 23:
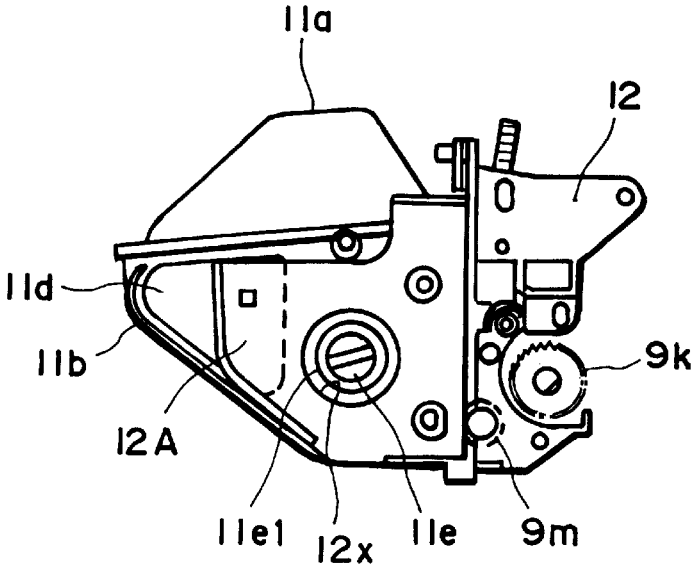
FIG. 23 is a side view of the side plate of the developing station portion, and the toner container portion, of the process cartridge illustrated in FIG. 13.
Figure 24:
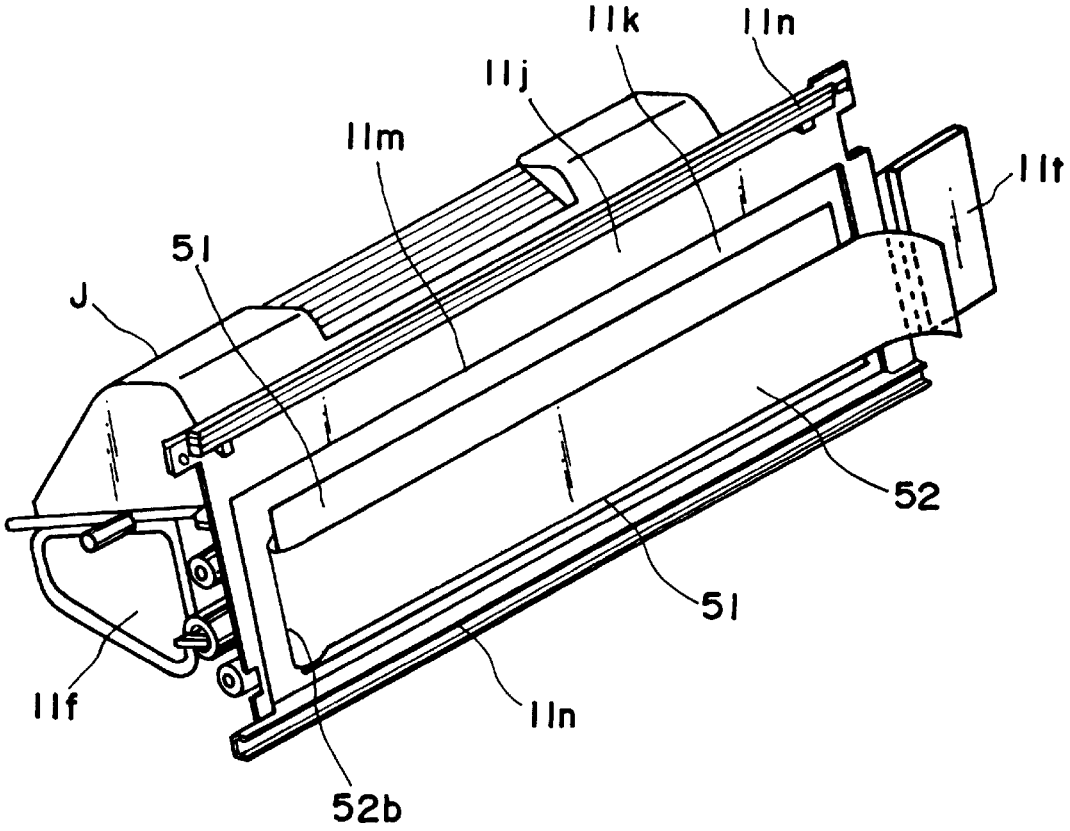
FIG. 24 is a perspective view of the toner container portion of the process cartridge illustrated in FIG. 13.

Referring to FIGS. 13, 15, 17, 19, 23 and 24, the toner chamber frame will be described in detail. FIG. 23 is a perspective view of the toner chamber frame as seen before a toner seal is welded on, and FIG. 24 is a perspective view of the toner chamber frame after toner is fitted in.

Referring to FIG. 13, the toner chamber frame 11 is constituted of two portions: the top and bottom portions 11*a* and 11*b*. Referring to FIG. 11, the top portion 11*a* bulges upward, occupying the space on the left-hand side of the optical system 1 in the image forming apparatus main assembly 14, so that the toner capacity of the process cartridge B can be increased without increasing the size of the image forming apparatus A. Referring to FIGS. 13, 14 and 17, the top portion 11*a* of the toner chamber frame 11 has a recessed portion 17, which is located at the lengthwise center portion of the top portion 11*a*, and serves as a handhold. An operator of the image forming apparatus can handle the process cartridge B by grasping it by the recessed portion 17 of the top portion 11*a* and the downward facing side of the bottom portion 11*b*. The ribs 11*c* extending on the downward facing surface of the bottom portion 11*b* in the lengthwise direction of the bottom portion 11*b* serve to prevent the process cartridge B from slipping out of the operator's hand. Referring again to FIG. 13, the flange 11*a*1 of the top portion 11*a* is aligned with the raised-edge flange 11*b*1 of the bottom portion 11*b*, the flange 11*a*1 being fitted within the raised edge of the flange 11*b*1 of the bottom portion 11*b*1, so that the walls of the top and bottom portions of the toner chamber frame 11 perfectly meet at the welding surface U, and then, the top and bottom portions 11*a* and 11*b* of the toner chamber frame 11 are welded together by melting the welding ribs with the application of ultrasonic waves. The method for uniting the top and bottom portions 11*a* and 11*b* of the toner chamber frame 11 does not need to be limited to ultrasonic welding. They may be welded by heat or forced vibration, or may be glued together. Further, the bottom portion 11*b* of the toner chamber frame 11 is provided with a stepped portion 11*m*, in addition to the flange 11*b*1 which keeps the top and bottom portions 11*a* and 11*b* aligned when they are welded together by ultrasonic welding. The stepped portion 11*m* is located above an opening 11*i* and is substantially in the same plane as the flange 11*b*1. The structures of stepped portion 11*m* and its adjacent areas will be described later.

Before the top and bottom portions 11*a* and 11*b* of the toner chamber frame 11 are united, a toner feeding member 9*b* is assembled into the bottom portion 11, and a coupling member 11*e* is attached to the end of the toner feeding member 9*b* through the hole 11*e*1 of the side wall of the toner chamber frame 11 as shown in FIG. 19. The hole 11*e*1 is located at one of the lengthwise ends of the bottom portion 11*b*, and the side plate which has the hole 11*e*1 is also provided with a toner filling opening 11*d* substantially shaped like a right triangle. The triangular rim of the toner filling opening 11*d* is constituted of a first edge which is one of two edges that are substantially perpendicular to each other, and extends along the joint between the top and bottom portion 11*a* and 11*b* of the toner chamber frame 11, a second edge which vertically extends in the direction substantially perpendicular to the first edge, and a third edge, that is, a diagonal edge, which extends along the slanted edge of the bottom portion 11*b*. In other words, the toner filling opening 11*d* is rendered as large as possible, while being located next to the hole 11*e*1. Thus, the toner filling opening lid can be maximized, so that the time required to fill the toner can be minimized. Next, referring to FIG. 19, the toner chamber frame 11 is provided with an opening 11*i* through which toner is fed from the toner chamber frame 11 into the image developing chamber frame 12, and a seal (which will be described later) is welded to seal this opening 11*i*. Thereafter, toner is filled into the toner chamber frame 11 through the toner filling opening 11*d*, and then, the toner filling opening 11*d* is sealed with a toner sealing cap 11*f* to finish a toner unit J. The toner sealing cap 11*f* is formed of polyethylene, polypropylene, or the like, and is pressed into, or glued to, the toner filling opening 11*d* of the toner chamber frame 11 so that it does not come off. Next, the toner unit J is welded to the image developing chamber frame 12, which will be described later, by ultrasonic welding, to form the image developing unit D. The means for uniting the toner unit J and the image developing unit D is not limited to ultrasonic welding; it may be glued or snap-fitting, which utilizes the elasticity of the materials of the two units.

Referring to FIG. 13, the slanted surface K of the bottom portion 11*b* of the toner chamber frame 11 is given an angle of θ so that the toner in the top portion of the toner chamber frame 11 naturally slides down as the toner at the bottom is consumed. More specifically, it is desirable that the angle θ formed between the slanted surface K of the process cartridge B in the apparatus main assembly 14 and the horizontal line Z is approximately 65 degrees when the apparatus main assembly 14 is horizontally placed. The bottom portion 11*b* is given an outwardly bulging portion 11*g* so that it does not interfere with the rotation of the toner feeding member 9*b*. The diameter of the sweeping range of the toner feeding member 9*b* is approximately 37 mm. The height of the bulging portion 11*g* has only to be approximately 0–10 mm from the imaginary extension of the slanted surface K. This is due to the following reason; if the bottom surface of the bulging portion 11*g* is above the imaginary extension of the slanted surface K, the toner which, otherwise, naturally slides down from the top portion of the slanted surface K and is fed into the image developing chamber frame 12, partially fails to be fed into the image developing chamber frame 12, collecting in the area where the slanted surface K and the outwardly bulging portion 11*g* meet. Contrarily, in the case of the toner chamber frame 11 in this embodiment, the toner is reliably fed into the image developing chamber frame 12 from the toner chamber frame 11.

The toner feeding member 9*b* is formed of a steel rod having a diameter of approximately 2 mm, and is in the form of a crank shaft. Referring to FIG. 19 which illustrates one end of the toner feeding member 9*b*, one 9*b*1 of the journals of the toner feeding member 9*b* is fitted in a hole 11*r* which is located in the toner chamber frame 11, adjacent to the opening 11*i* of the toner chamber frame 11. The other of the journals is fixed to the coupling member 11*e* (where the journal is fixed to the coupling member 11*e* is not visible in FIG. 19).

As described above, providing the bottom wall of the toner chamber frame section 11 with the outwardly bulging portion 11*g* as the sweeping space for the toner feeding member 9*b* makes it possible to provide the process cartridge B with stable toner feeding performance without a cost increase.

Figure 25:
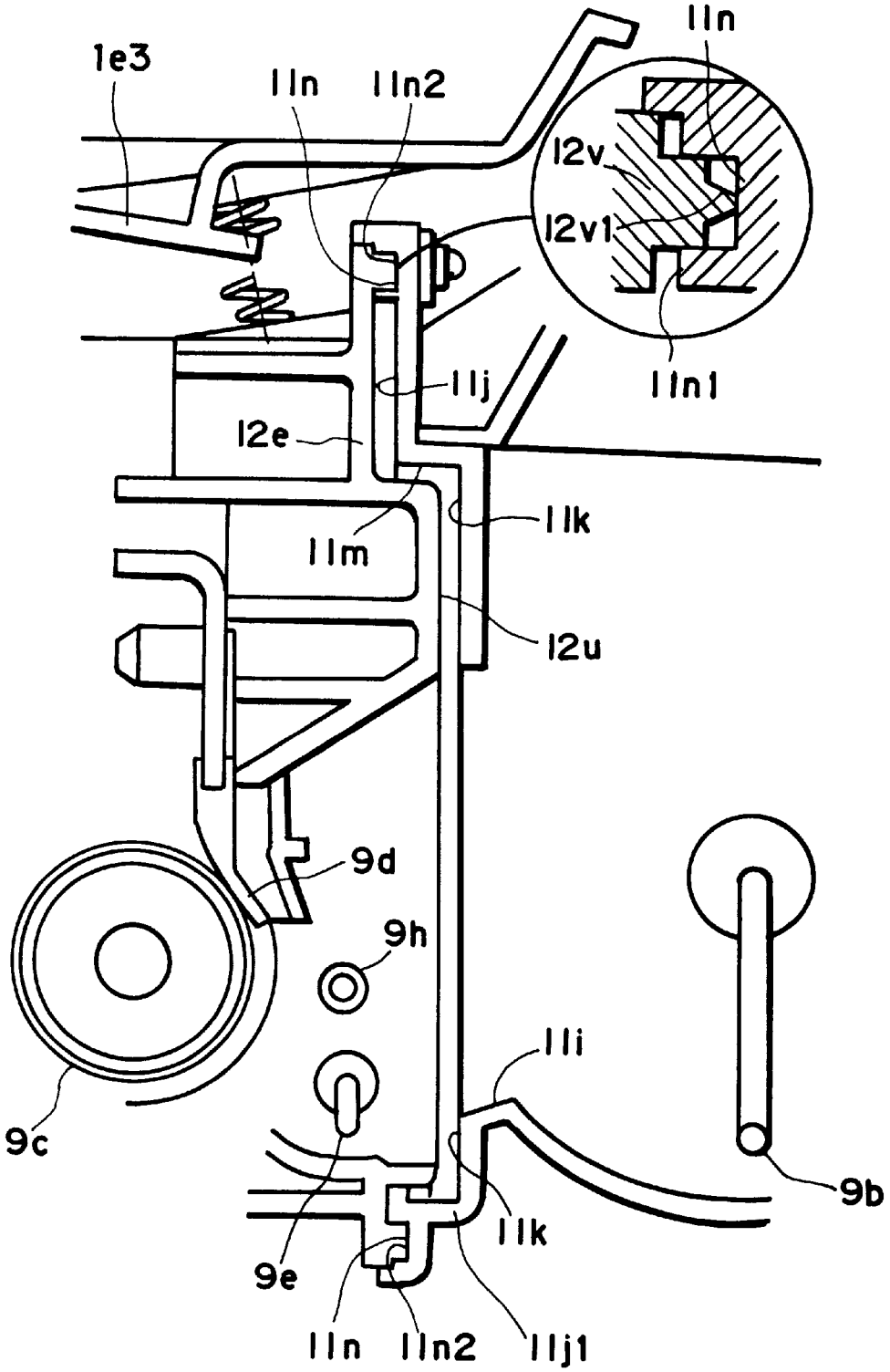
FIG. 25 is a vertical section of the toner sealing portion of the toner container portion of the process cartridge illustrated in FIG. 13.

Referring to FIGS. 13, 19 and 25, the opening 11*i* through which toner is fed from the toner chamber frame section 11 into the development chamber frame section is located at the joint between the toner chamber frame section 11 and the development chamber frame section 12. The opening 11*i* is surrounded by an recessed surface 11*k*, which in turn is surrounded by the top and bottom portions 11*j* and 11*j*1 of the flange of the toner chamber frame 11. The lengthwise outer (top) edge of the top portion 11*j* and the lengthwise outer (bottom) edge of the bottom portion 11*j*1 are provided with grooves 11*n*, respectively, which are parallel to each other. The top portion 11*j* of the flange above the recessed surface 11*k* is in the form of a gate, and the surface of the bottom portion 11*j*1 of the flange is perpendicular to the surface of the recessed surface 11*k*. Referring to FIG. 25, the plane of the bottom surface 11*n*2 of the groove 11*n* is on the outward side (toward the image developing chamber frame 12) of the surface of the recessed surface 11*k*. However, the flange of the toner chamber frame 11 may be structured like the flange illustrated in which the top and bottom portion 11*j* of the flanges are in the same plane and surround the opening 11*i* like the top and bottom pieces of a picture frame.

Referring to FIG. 20, an alphanumeric reference 12*u* designates one of the flat surfaces of the image developing chamber frame 12, which faces the toner chamber frame 11. The flange 12*e* which is parallel to the flat surface 12*u* and surrounds all four edges of this flat surface 12*u* like a picture frame is provided at a level slightly recessed from the flat surface 12*u*. The lengthwise edges of the flange 12*e* are provided with a tongue 12*v* which fit into the groove 11*n* of the toner chamber frame 11. The top surface of the tongue 12*v* is provided with an angular ridge 12*v*1 (FIG. 25) for ultrasonic welding. After the various components are assembled into the toner chamber frame 11 and image developing chamber frame 12, the tongue of the image developing chamber frame 12 is fitted into the groove 11*n* of the toner chamber frame 11, and the two frames 11 and 12 are welded together along the tongue 12*v* and groove 11*n* (detail will be given later).

Referring to FIG. 24, a cover film 51, which can be easily torn in the lengthwise direction of the process cartridge B, is pasted to the recessed surface 11*k* to seal the opening 11*i* of the toner chamber frame 11; it is pasted to the toner chamber frame 11, on the recessed surface 11*k*, alongside the four edges of the opening 11*i*. In order to unseal the opening 11*i* by tearing the cover film 51, the process cartridge B is provided with a tear tape 52, which is welded to the cover film 51. The cover tape 52 is doubled back from the lengthwise end 52*b* of the opening 11*i*, is put through between an elastic sealing member 54 such as a piece of felt (FIG. 20) and the opposing surface of the toner chamber frame 11, at the end opposite to the end 52*b*, and is slightly extended from the process cartridge B. The end portion 52*a* of the slightly sticking out tear tape 52 is adhered to a pull-tab 11*t* which is to be grasped with the hand (FIGS. 16, 19 and 24). The pull-tab 11*t* is integrally formed with the toner chamber frame 11, wherein the joint portion between the pull-tab 11*t* and the toner chamber frame 11 is substantially thin so that the pull-tab 11*t* can be easily torn away from the toner chamber frame 11. The surface of the sealing member 54, except for the peripheral areas, is covered with a synthetic resin film tape 55 having a small friction coefficient. The tape 55 is pasted to the sealing member 54. Further, the flat surface 12*e* located at the other of the lengthwise end portions of the toner chamber frame 11, that is, the end portion opposite to the position where the elastic sealing member 54 is located, is covered with the elastic sealing member 56, which is pasted to the flat surface 12*e* (FIG. 20).

The elastic sealing members 54 and 56 are pasted on the flange 12*e*, at the corresponding lengthwise ends, across the entire width of the flange 12*e*. As the toner chamber frame 11 and the image developing chamber frame 12 are joined, the elastic sealing members 54 and 56 exactly cover the corresponding lengthwise end portions of the flange 11*j* surrounding the recessed surface 11*k*, across the entire width the flange 11*j*, overlapping with the tongue 12*v*.

Further, in order to precisely position the toner chamber frame 11 and the image developing chamber frame 12 relative to each other when they are joined, the flange 11*j* of the toner chamber frame 11 is provided with a round hole 11*r* and a square hole 11*q* which engage with the cylindrical dowel 12*w*1 and square dowel 12*w*2, respectively, of the image developing chamber frame 12. The round hole 11*r* tightly fits with the dowel 12*w*1, whereas the square hole 11*q* loosely fits with the dowel 12*w*2 in terms of the lengthwise direction while tightly fitting therewith in terms of the lengthwise direction.

The toner chamber frame 11 and the image developing chamber frame 12 are independently assembled as a compound component prior to a process in which they are united. Then, they are united in the following manner. First, the cylindrical positioning dowel 12*w*1 and square positioning dowel 12*w*2 of the image developing chamber frame 12 are fitted into the positioning round hole 11*r* and positioning square hole 11*q* of the toner chamber frame 11, and the tongue 12*v* of the image developing chamber frame 12 is placed in the groove 11*n* of the toner chamber frame 11. Then, the toner chamber frame 11 and the image developing chamber frame 12 are pressed toward each other. As a result, the sealing members 54 and 56 come in contact with, being thereby compressed by, the corresponding lengthwise end portions of the flange 11*j*, and at the same time, a rib-like projections 12*z*, which are located, as a spacer, at each lengthwise end of the flat surface 12*u* of the image developing chamber frame 12, are positioned close to the flange 11*j* of the toner chamber frame 11. The rib-like projection 12*z* is integrally formed with the image developing chamber frame 12, and is located at both sides, relative to the lengthwise direction, of the tear tape 52, so that the tear tape can be passed between the opposing projections 12*z*.

With the toner chamber frame 11 and the image developing chamber frame 12 being pressed toward each other as described above, ultrasonic vibration is applied between the tongue-like portion 12*v* and the groove 11*n*. As a result, the angular ridge 12*v*1 is melt by frictional heat and fuses with the bottom of the groove 11*n*. Consequently, the rim portion 11*n*1 of the groove 11*n* of the toner chamber frame 11 and the rib-like projection 12*z* of the image developing chamber frame 12 remain airtightly in contact with each other, leaving a space between the recessed surface 11*k* of the toner chamber frame 11 and the flat surface 12*u* of the image developing chamber frame 12. The aforementioned cover film 51 and tear tape 52 fit in this space.

In order to feed the toner stored in the toner chamber frame 11 into the image developing chamber frame 12, the opening 11*i* of the toner chamber frame 11 must be unsealed. This is accomplished in the following manner. First, the pull-tab 11*t* attached to the end portion 52*a* (FIG. 16) of the tear tape 52 extending from the process cartridge B is cut loose, or torn loose, from the toner chamber frame 11, and then, is pulled by the hand of an operator. This will tear the cover film 51 to unseal the opening 11*i*, enabling the toner to be fed from the toner chamber frame 11 into the image developing chamber frame 12. After the cover film 52 is pulled out of the process cartridge B, the lengthwise ends of the cartridge B are kept sealed by the elastic seals 54 and 56 which are located at the corresponding lengthwise ends of the flange 11*j* of the toner chamber frame 11. Since the elastic sealing members 54 and 56 are deformed (compressed) only in the direction of their thickness while maintaining their hexahedral shapes, they can keep the process cartridge sealed very effectively.

Since the side of the toner chamber frame 11, which faces the image developing chamber frame 12, and the side of the image developing chamber frame 12, which faces the toner chamber frame 11, are structured as described above, the tear tape 52 can be smoothly pulled out from between the two frames 11 and 12 by simply applying to the tear tape 52 a force strong enough to tear the cover film 51.

As described above, when the toner chamber frame 11 and the image developing chamber frame 12 are united, a welding method employing ultrasonic is employed to generate frictional heat which melts the angular ridge 12*v*1. This frictional heat is liable to cause thermal stress in the toner chamber frame 11 and the image developing chamber frame 12, and these frames may become deformed due to the stress. However, according to this embodiment, the groove 11*n* of the toner chamber frame 11 and the tongue 12*v* of the image developing chamber frame 12 engage with each other across the almost entire length of theirs. In other words, as the two frames 11 and 12 are united, the welded portion and its adjacent areas are reinforced, and therefore, the two frames are not likely to be deformed by the thermal stress.

As for the material for the toner chamber frame 11 and the image developing chamber frame 12, plastic material is used; for example, polystyrene, ABS resin (acrylonitrile-butadiene-styrene), polycarbonate, polyethylene, polypropylene, and the like.

Referring to FIG. 13, this drawing is a substantially vertical cross-section of the toner chamber frame 11 of the process cartridge B in this embodiment, and illustrates the interface between the toner chamber frame 11 and the image developing chamber frame 12, and its adjacent areas.

At this time, the toner chamber frame 11 of the process cartridge B in this embodiment will be described in more detail with reference to FIG. 13. The toner held in a toner container 11A is single component toner. In order to allow this toner to efficiently free fall toward the opening 11*i*, the toner chamber frame 11 is provided with slanted surfaces K and L, which extend across the entire length of the toner chamber frame 11. The slanted surface L is above the opening 11*i*, and the slanted surface K is in the rear of the toner chamber frame 11 as seen from the opening 11*i* (in the widthwise direction of the toner chamber frame 11). The slanted surfaces L and K are parts of the top and bottom pieces 11*a* and 11*b*, respectively, of the toner chamber frame 11. After the process cartridge B is installed in the apparatus main assembly 14, the slanted surface L faces diagonally downward, and the slanted surface K faces diagonally upward, the angle θ3 between the slanted surface K and the line m perpendicular to the interface between the toner chamber frame 11 and the image developing chamber frame 12 being approximately 20 deg.–40 deg. In other words, in this embodiment, the configuration of the top portion 11*a* of the toner chamber frame 11 is designed so that the slanted surfaces K and L hold the aforementioned angles, respectively, after the top and bottom portions 11*a* and 11*b* of the toner chamber frame 11 are united. This, according to this embodiment, the toner container 11A holding the toner is enabled to efficiently feed the toner toward the opening 11*i*.

(Toner Container Cap)

Next, a toner container cap 11*f* will be described.

Figure 26:
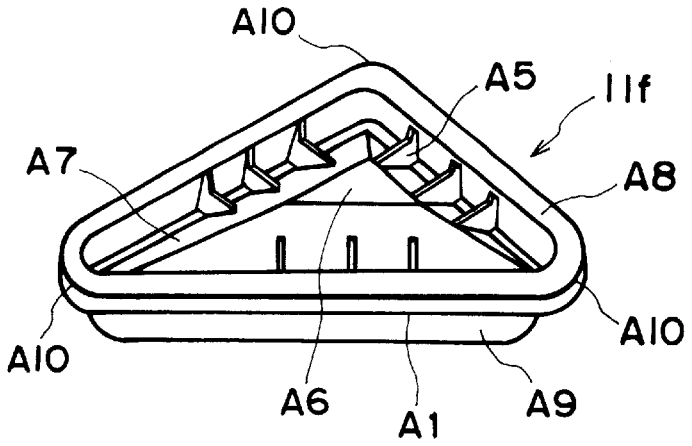
FIG. 26 is a perspective view of a cap for a toner container.
Figure 27:
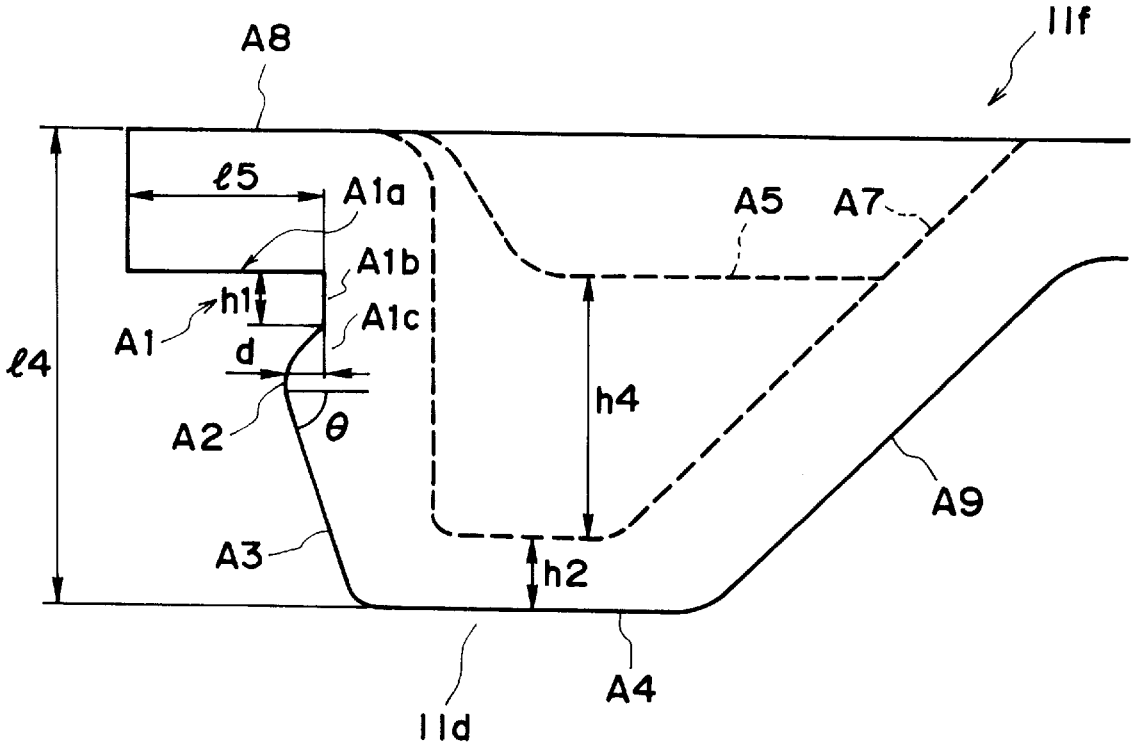
FIG. 27 is a section of the toner container cap illustrated in FIG. 26.
Figure 28:
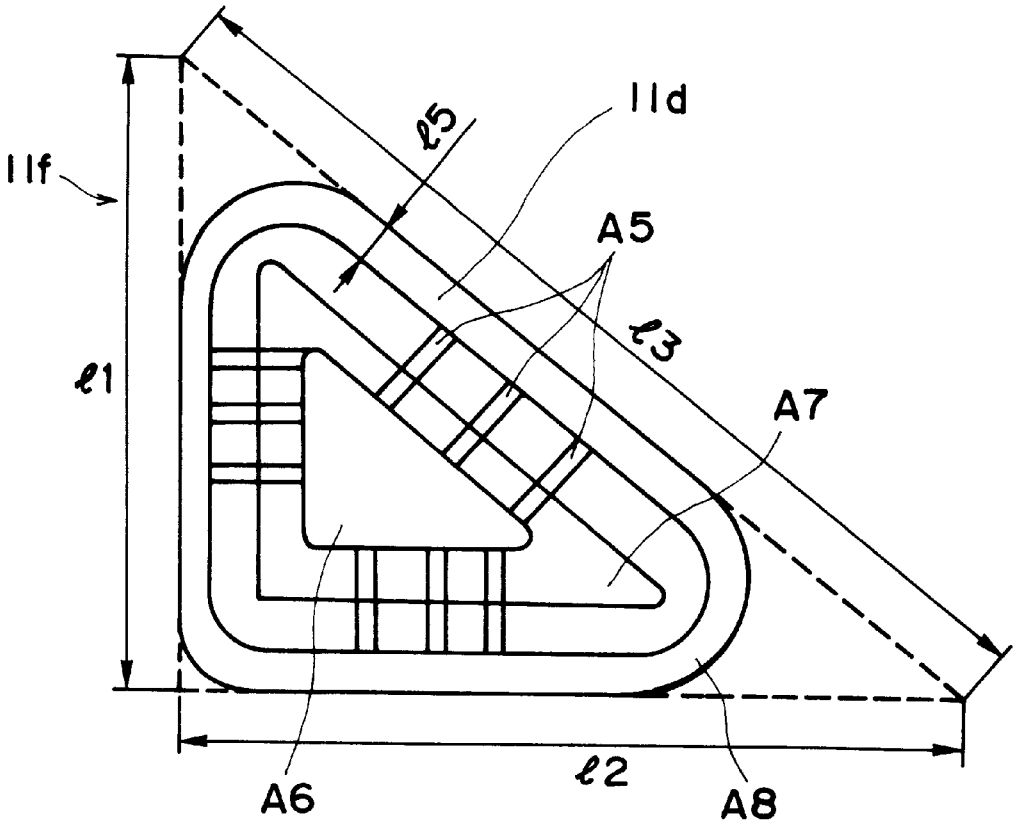
FIG. 28 is a top view of the toner container cap illustrated in FIG. 26.

FIGS. 26, 27 and 28 are perspective, sectional, and top views of the toner container cap 11 in accordance with the present invention.

In this embodiment, the configuration of the toner container cap 11*f* is substantially triangular. This toner container cap 11*f* has a groove portion A1 which is the sealing portion, a bulge A2, the slanted surface A3 of the bulge A2, a bottom wall A4, reinforcement ribs A5, a knob portion A6, a slanted surface A7, a brim portion A8, a slanted internal surface A9, and the like. The groove portion A1 comprises the side wall surface A1*a* on the top side of the drawing, the bottom surface A1*b* on the right-hand side of the drawing, and the side wall surface A1*c* on the bottom side of the drawing. As is evident from FIG. 26, the configuration of the toner container cap 11*f* is round at the apex portions A10. The knob portion A6 is where the suction of the suction cup of an assembly robot is applied to pick up the toner container cap 11*f* when the toner container cap 11*f* is fitted to the toner filling opening 11*d* of a toner container 11A.

Figure 29:
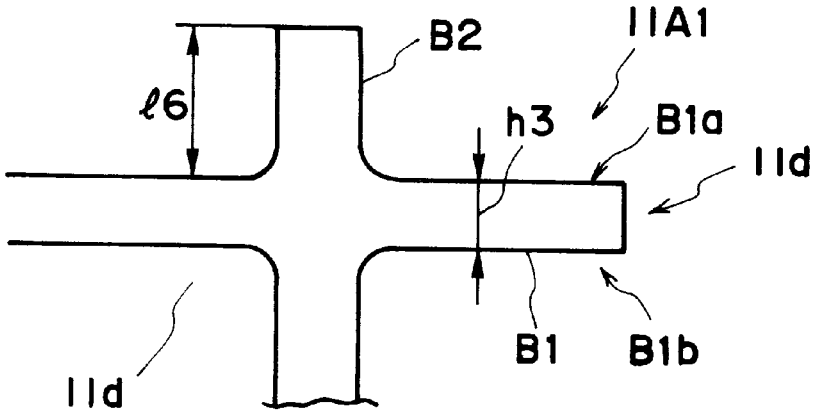
FIG. 29 is a section of a portion of the toner filling opening of the toner container portion of the main structure of the process cartridge illustrated in FIG. 13.

The width h1 of the bottom surface A1*b* of the groove portion A1 is rendered less than the thickness h3 of the brim portion B1 of the toner filling opening 11*d* formed in one of the side walls of the main structure 11A1 of the toner container 11A illustrated in FIG. 29, so that the toner container 11A is sealed by the toner container cap 11*f* as the brim portion B1 of the toner filling opening 11*d* is forced to wedge into the groove portion A1 of the toner container cap 11*f* when the toner container cap 11*f* is fitted to the toner filling opening 11*d*.

The height d of the bulge A2 (FIG. 27) is desired to be in a range of 0.4 mm to 1.0 mm, more desirably, in a range of 0.45 mm to 0.9 mm, because of the distance the brim portion of the toner filling opening 11*d* must be allowed to wedge into the groove portion A1. The most desirable range is from 0.5 mm to 0.8 mm. The actual height d in this embodiment is 0.7 mm.

The slanted surface A3 of the bulge A2 is necessary to allow the toner container cap 11*f* to be smoothly pressed into the toner filling opening 11*d* in order to cap the toner container 11A. The angle θ of the slanted surface A3 is desired to be no less than 30 deg. and no more than 90 deg., more desirably, no less than 45 deg., and most desirably, in a range of no less than 60 deg. and no more than 80 deg. The actual angle of the slanted surface A3 in this embodiment is 70 deg.

The thickness h2 of the bottom wall A4 of the toner container cap 11*f* is rendered less than the basic thickness of the wall of the toner container cap 11*f*. In this embodiment, the basic thickness of the wall of the toner container cap 11*f* is 1.5 mm, and the thickness h2 of the bottom wall A4 is 1.0 mm. This arrangement is made to minimize the deformation of the toner container cap 11*f* which occurs during the capping of the toner container 11A, so that the creeping the toner container wall, which is liable to occur on the back side of the groove portion A1, can be prevented.

As for the reinforcement rib A5, two or more are provided per straight wall portion of the toner container cap 11*f* to prevent the straight wall portions from being bent and declining in sealing ability after the toner container cap 11*f* is fitted in the toner filling opening 11*d*. In this embodiment, each straight wall portion is provided with three reinforcement ribs A5. The reinforcement rib 5A is arranged to extend toward the periphery of the toner container cap from the knob portion A6 provided at the center of the toner container cap 11*f*. The height h4 of the reinforcement rib A5 is desired to be no less than 1.0 mm and no more than 3.0 mm, more desirably, no less than 1.5 mm and no more than 2.5 mm, and most desirably, in a range of 1.8 mm to 2.2 mm. In this embodiment, it is 2.0 mm.

The slanted surface A7 and the slanted interior surface A9 are provided to minimize the deformation of the toner container cap 11*f* which occurs during the capping of the toner container 11A, and also to prevent creeping which is liable to occur to the back side of the groove portion A1.

When a toner container is sealed by allowing the brim portion of the toner filling opening to wedge into the groove portion of the toner container cap 11*f* as it is in this embodiment, the following materials are desirable as the material for the toner container cap 11*f* in consideration of stability in sealing ability and creep prevention after the capping.

First, regarding the hardness of the material, it is desirable that the hardness of the toner container cap 11*f* in Rockwell hardness scale (measured based on JIS-K7202) is less than that of the main structure 11A1 of the toner container 11A. More specifically, the hardness of the toner container cap 11*f* is desired to be in a range of R30–R80, more desirably, in a range of R40–R50, and most desirably, R45. In this embodiment, it is R45. As for the hardness of the main structure 11A1 of the toner container 11A, a hardness range of R80–R150 is desirable, more desirably, in a range of R100–R140, and most desirably, R120. In this embodiment, it is R125.

In terms of the modulus of elasticity relative to bending (measured according to JIS-K7203), it is desirable that the toner container cap 11*f* is less than the main structure 11A1. More specifically, the modulus of elasticity, relative to bending, of the toner container cap 11*f* is desired to be no less than 800 kg/cm$^2$ and no more than 10,000 kg/cm$^2$, more desirably, no less than 1,300 kg/cm$^2$ and no more than 9,000 kg/cm$^2$, and most desirably, 2,000 kg/cm$^2$. In this embodiment, it is 1,700 kg/cm$^2$. As for the modulus of elasticity, relative to bending, of the container main structure 11A1, it is desired to be no less than 20,000 kg/cm$^2$ and no more than 30,000 kg/cm$^2$, more desirably, no less than 22,500 kg/cm$^2$ and no more than 28,000 kg/cm$^2$, and more desirably, 25,000 kg/cm$^2$. In this embodiment, it is 24,500 kg/cm$^2$.

In order to prevent the creeping after the capping, the yield point (measured according to JIS-K7113) of the material for the toner container cap 11*f* in a tensile strength test is desired to be less than that of the material for the container main structure 11A1. More specifically, the yield point of the toner container cap 11*f* is desired to be no less than 80 kg/cm$^2$ and no more than 200 kg/cm$^2$, more desirably, no less than 90 kg/cm$^2$ and no more than 190 kg/cm$^2$, and most desirably, 150 kg/cm$^2$. In this embodiment, it is 120 kg/cm$^2$.

As for the yield point for the container mains structure 11A1, it is desired to be no less than 250 kg/cm$^2$ and no more than 500 kg/cm$^2$, more desirably, no less than 260 kg/cm$^2$ and no more than 400 kg/cm$^2$, and most desirably, 270 kg/cm$^2$ and no more than 320 kg/cm$^2$. In this embodiment, it is 270 kg/cm$^2$.

As for specific materials for the toner container cap 11*f*, low density polyethylene, for example, is used. As for the material for the container main structure 11A1, HIPS is employed in consideration of the impact to which a toner container is liable to be subjected during the transportation of the toner container. Both the toner container cap 11*f* and the container main structure 11A1 are formed by injection molding.

Referring to FIG. 29, the toner filling opening 11*d* of the container main structure 11A1 is provided with a brim portion B1, and a cap guide B2 which serves as an insertion guide during the capping. These portions of the toner filling opening 11*d* are integrally formed with the container main structure 11A1. The brim portion B1 comprises a chamfered top edge portion B1*a* and a rounded (no more than 0.3) bottom edge portion B1*b*. Further, referring to FIG. 30, the side wall portion A1*c* of the groove portion A1, on the downward side, of the toner container cap 11*f* is provided with a straight slanted surface A1*c*, so that the sealability of the toner container 11A is greatly improved the bottom edge portion B1*b* of the brim portion B1 of the container main structure 11A1 firmly bite into this slanted surface A1*c*. In this embodiment, the rounding of bottom edge portion B1*b* is set at 0.3.

Figure 30:
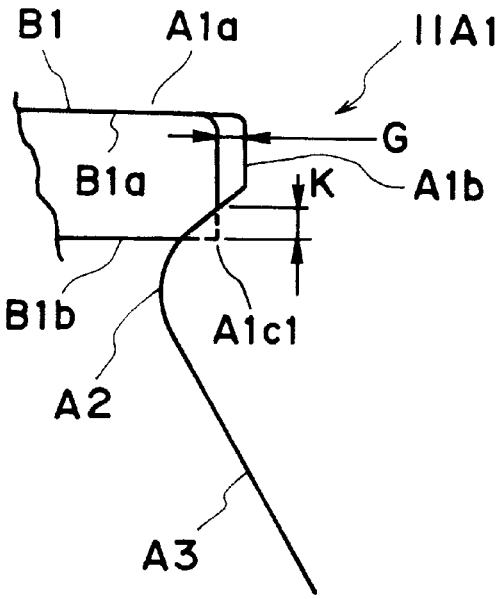
FIG. 30 is a section of a portion of the toner container cap, which engages with the edge of the toner filling opening.

Also referring to FIG. 30, a referential figure K designates the distance (bite) the container cap 11*f* is forced into the container main structure 11A1. This distance K is desired to be no less than 0.2 mm and no more than 1.0 mm, more desirably, no less than 0.3 mm and no more than 0.9 mm, and most desirably, 0.7 mm. In this embodiment, it is 0.7 mm.

The sealed state of the toner container 11A is created by forcing the toner container cap 11*f* into the toner filling opening 11*f* of the container main structure 11A1, and in order to prevent the contact between the toner filling opening 11*d* and the unintended portion of the toner container cap 11*f* from reducing the airtightness of the capped toner container 11A, the groove portion A1 and the toner filling opening 11*d* are designed to leave a gap G between the brim portion A1*b* and the bottom wall A1*b* of the groove portion A1, as illustrated in FIG. 30, after the capping. This gap G is desired to be no less than 0.1 mm and no more than 2.0 mm. In this embodiment, it is set at 0.2 mm.

Figure 31:
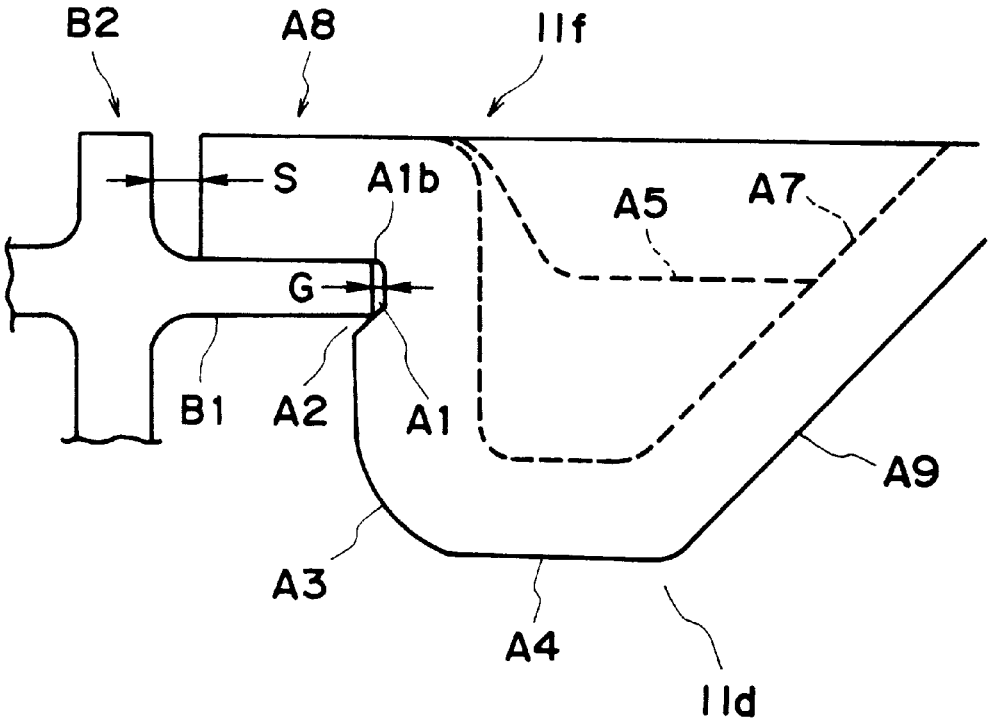
FIG. 31 is a section of the joint between a toner container cap and the edge of the toner filling opening of the toner container portion.

Further, referring to FIG. 31, a gap S between the cap guide B2 and the toner container cap 11*f* is desired to be no less than 0.2 mm and no more than 2.0 mm. In this embodiment, it is 0.3 mm.

The essential measurements of the toner container cap 11*f* and the toner filling opening lid in this embodiment are given below (FIGS. 27, 28 and 29).

| | |
|---|---|
| First side wall length of container cap (11): | 39.14 (mm) |
| Second side wall length of container cap (12): | 49.56 (mm) |
| Third side wall length of container cap (13): | 50.41 (mm) |
| Height of container cap (14): | 4.50 (mm) |
| Width of container cap brim portion (15): | 2.60 (mm) |
| Height of container cap guide (16): | 2.80 (mm) |

The container main structures 11A1 which were formed according to the above specifications were subjected to capping tests, in which they were tested for creeping, and the time it took to fit a toner container cap. They are also subjected to transportation tests, in which they are tested for being leakproof, and tests, in which the amount of stress it took to dislodge the toner container cap 11*f* from the toner filling opening 11*d* was determined.

The conditions under which the tests were conducted are as follows.

(1) Capping Test

The pressing time (time it takes to completely insert the toner container cap 11*f* into the toner filling opening 11*d*) was measured while applying a pressure of 160 kgf to seal the toner container with the toner container cap 11*f*. Further, the toner container cap 11*f*, and the toner filling opening 11*d* of the container main structure 11A1, were checked for the presence of creep. A pressing time of no more than 2.5 seconds is deemed satisfactory for an automatic toner filling apparatus.

(2) Transportation Test

Toner container 11A was filled with 460 g of magnetic single component toner having an average particle diameter of 8 $\mu$m, and was allowed to free fall from a height of 100 cm, causing it to land on each of six surfaces and four corners.

(3) Dislodgment Stress Test

A stress measuring head was pushed toward the toner filling opening from inside the container main structure 11A1 at a rate of 100 mm/min., and the maximum stress was measured the moment the toner container cap 11*f* became dislodged from the toner filling opening 11*d*.

Figure 32:
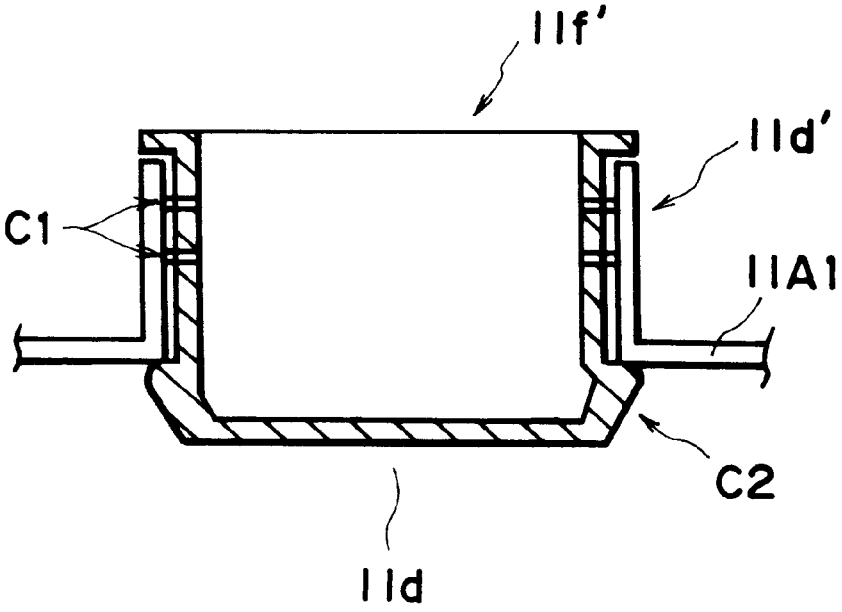
FIG. 32 is a section of a portion of a toner container cap, which engages with the edge of the toner filling opening, in a comparative embodiment.

Further, a total of 13 container main structures were produced, which were different in the distance the toner container cap was pressed into the toner filling opening, the bulge angle, the bulge height, the Rockwell hardness, and the like. For a performance comparison, a circular toner container cap 11*f'* illustrated in FIG. 32, was produced using low density polyethylene by injection molding. In the case of this comparative toner container cap 11*f'*, the effective area of the toner filling opening 11*d'* was the same as the toner filling opening 11*d* described in the preceding embodiments of the present invention; the modulus of elasticity, relative to bending, was 2000 kg/cm$^2$; the height of the rib C1 was 1.75 mm; and the latching portion C2 on one side was 0.15 mm.

The results of comparison are given in the following Table 2. According to this table, those in accordance with the preceding embodiments of the present invention have no problem at all in sealing performance. But, among those comparative toner container caps 11*f'* used in combination with the container main structure 11A1, none was satisfactory across the entire battery of tests. However, even the structures described in the comparative embodiments can be used as satisfactory structures for the toner container cap and the toner container depending on the type of usage. For example, even those which suffer from creeping, that is, those which are inferior in durability, are usable as long as the amount of toner to be contained is small. In other words, the caps and container main structures described in the embodiments of the present invention can afford more latitude in their usage, and are better in toner filling efficiency, than those described in the comparative embodiments.

TABLE 2

| | | CAP & CONTAINER CAP CREEP | PRESS FITTING TIMES (sec) | TRANS. TEST | DISLODGE TEST | REMARKS DIFFERENT FROM EMB. |
|---|---|---|---|---|---|---|
| EMB. | 1 | NO | 1.2 | G | 38 | |
| | 2 | NO | 1 | G | 30 | BT = 0.2 mm |
| | 3 | NO | 1.7 | G | 52 | BT = 0.9 mm |
| | 4 | NO | 1.5 | G | 46 | NA = 30 deg. |
| | 5 | NO | 0.8 | G | 36 | NA = 85 deg. |
| | 6 | NO | 1.1 | G | 33 | NP = 0.4 mm |
| | 7 | NO | 1.9 | G | 55 | NP = 1.0 mm |
| | 8 | NO | 1.1 | G | 35 | RH: CAP = R32<br>CON = R148 |
| | 9 | NO | 1.3 | G | 41 | RH: CAP = R75<br>CON = R83 |
| | 10 | NO | 1.1 | G | 36 | BE: CAP = 840 kg/cm$^2$<br>CON = 28990 kg/cm$^2$ |
| | 11 | NO | 1.4 | G | 40 | BE: CAP = 9980 kg/cm$^2$ |

TABLE 2-continued

| | | CAP & CONTAINER CAP CREEP | PRESS FITTING TIMES (sec) | TRANS. TEST | DISLODGE TEST | REMARKS DIFFERENT FROM EMB. |
|---|---|---|---|---|---|---|
| | | | | | | CON = 20050 kg/cm$^2$ |
| | 12 | NO | 1.1 | G | 37 | YP: CAP = 80 kg/cm$^2$<br>CON = 490 kg/cm$^2$ |
| | 13 | NO | 1.4 | G | 36 | YP: CAP = 190 kg/cm$^2$<br>CON = 250 kg/cm$^2$ |
| COMP. | 1 | NO | 0.6 | NG | 15 | |
| EMB. | 2 | NO | 0.8 | NG | 24 | BT = 0.15 mm |
| | 3 | YES (CAP) | 2.5NG | G | 55 | BT = 1.2 mm |
| | 4 | YES (CAP) | 2.8NG | G | 42 | NA = 25 deg. |
| | 5 | NO | 0.9 | NG | 27 | NP = 0.35 mm |
| | 6 | YES (CAP) | 3.0NG | G | 58 | NP = 1.05 mm |
| | 7 | YES (CON) | 1.1 | G | 25 | RH: CAP = R85<br>CON = R75 |
| | 8 | NO | 3.0NG | G | 26 | RH: CAP = R85<br>CON = R155 |
| | 9 | NO | 1 | NG | 24 | RH: CAP = R25<br>CON = R155 |
| | 10 | YES (CON) | 1.1 | G | 26 | BE: CAP = 10200 kg/cm$^2$<br>CON = 18480 kg/cm$^2$ |
| | 11 | NO | 2.9NG | G | 27 | BE: CAP = 10200 kg/cm$^2$<br>CON = 30080 kg/cm$^2$ |
| | 12 | NO | 1 | NG | 24 | BE: CAP = 780 kg/cm$^2$<br>CON = 30080 kg/cm$^2$ |
| | 13 | YES (CON) | 1.1 | G | 25 | YP: CAP = 210 kg/cm$^2$<br>CON = 240 kg/cm$^2$ |

G: GOOD
NG: NO GOOD
BT: BITE OF CAP
NA: NOTCH ANGLE
NP: NOTCH PROJECTION
RH: ROCKWELL HARDNESS
CON: CONTAINER
BE: BENDING ELASTICITY
YP: YIELD POINT

As described above, in terms of pressing time, the toner container 11A described in the embodiments of the present invention were not greatly different from the conventional toner container described in the comparative embodiments, but in terms of being leakproof during the transportation, the former were better than the latter. Further, in terms of the cap dislodgment resistance, the former were twice as good as the latter.

Further, the toner container 11A was assembled into a process cartridge, and then, was subjected to the transportation test. The results of the test confirmed that the toner container cap 11*f* had no problem in sealing effectiveness.

Figure 33:
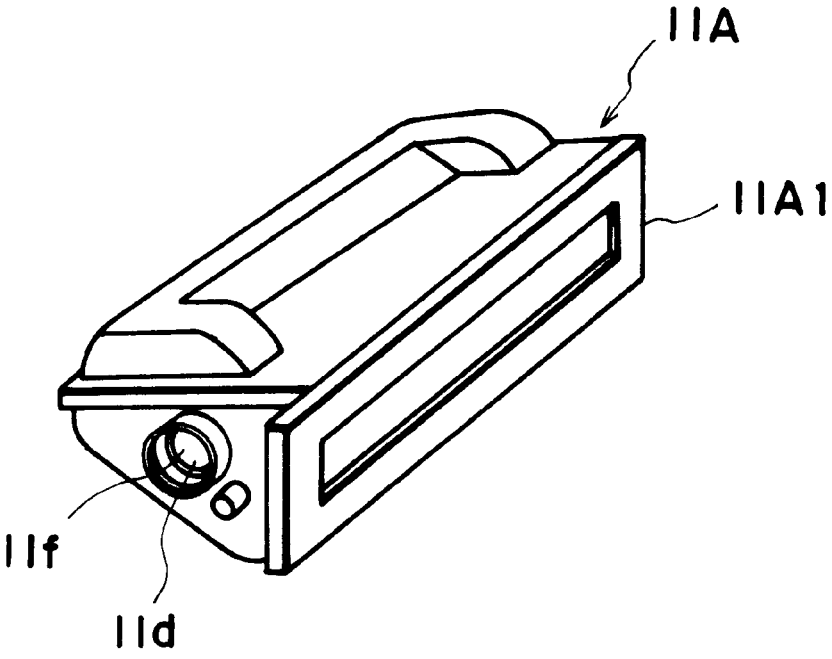
FIG. 33 illustrates a different configuration of a toner container cap.

In the preceding embodiments of the present invention, the projected shapes of the toner container caps 11*f* were substantially triangular, but the configuration of the toner container cap 11*f* may also be circular as illustrated in FIG. 33, substantially square as previously described and illustrated in FIG. 24, or in other polygonal or noncircular shapes; there is no restriction. Further, the material for the toner container caps 11*f* was low density polyethylene, and the material for the container main structures 11A1 was impact resistant polystyrene, but there is no specific restriction regarding the material choice as long as the material for the toner container cap 11*f* is smaller in terms of Rockwell hardness, modulus of elasticity in bending, yield point, and the like, than the material for the container main structure.

For example, a toner container comprising a toner container cap 11*f* formed of polypropylene, and a container main structure 11A1 formed of the other HIPS, for example, ABS, PPE, or PPO, is also satisfactorily usable.

Further, as for the configuration of the reinforcement rib, its lengthwise vertical section may be in a semicircular form which bows downward, as long as its can provide effective reinforcement.

As described above, according to the preceding embodiments of the present invention, a toner container is provided with a sealing portion at which the brim portion of the toner filling opening wedges into the groove portion of the toner container cap, and therefore, the toner container is greatly improved in terms of the resistance to the toner leakage which might occur during its transportation. Further, it is possible to provide a toner container which can be reliably capped without deformation, as well as a process cartridge employing such a toner container.

In other words, according to the present invention, the toner filling opening of a toner container is greatly improved in terms of sealing performance (leakage resistance).

These and other objects, features and advantages of the present invention will become more apparent upon a consideration of the following description of the preferred embodiments of the present invention taken in conjunction with the accompanying drawings.

What is claimed is:

1. A toner accommodation container comprising:

a toner containing portion for containing toner;

a toner filling opening for filling the toner into said toner containing portion; and a toner cap for sealing said toner filling opening, said toner cap including a sealing portion for sealing said toner filling opening, and a groove for engagement with an engaging portion provided in the body of said toner containing portion, wherein said groove is engaged by said engaging portion when said toner cap seals said toner filling opening.

2. A container according to claim 1, wherein said toner filling opening has a substantially polygonal configuration.

3. A container according to claim 2, wherein said toner filling opening has a substantially triangular configuration.

4. A container according to claim 2 or 3, wherein said toner cap has substantially the same configuration as said toner filling opening, said toner cap having a rib substantially perpendicular to a side wall of said toner cap.

5. A container according to one of claims 1, 2, or 3, wherein said toner accommodation container is in the form of a unit which is integral with a developing device and is detachably mountable to a main assembly of an electrophotographic image forming apparatus.

6. A container according to claim 1, wherein an edge portion of said engaging portion contacts said groove.

7. A toner cap for sealing a toner filling opening for filling toner into a body of a toner accommodation container for accommodating the toner, comprising:

a sealing portion for sealing said toner filling opening; and a groove for engagement with an engaging portion provided in the body of said toner accommodation container;

wherein said groove is engaged by said engaging portion when said toner cap seals said toner filling opening.

8. A cap according to claim 7, wherein said groove extends all around an outer edge of said cap.

9. A cap according to claim 7 or 8, further comprising a flange along an outer periphery of said cap, wherein said flange is above said groove when said toner cap seals said toner filling opening.

10. A cap according to claim 7 or 8, further comprising a flat knob projected outwardly at a substantially central portion outside of said cap, wherein said outside of said cap is outside said toner accommodation container when said toner cap seals said toner filling opening.

11. A cap according to claim 10, further comprising a plurality of ribs extending from a portion where said knob is provided toward the periphery of said cap.

12. A cap according to claim 11, wherein a height of said ribs is not less than 1.0 mm and not more than 3.0 mm.

13. A cap according to claim 7, wherein a biting portion between said groove portion and an edge portion of said filling opening is linearly inclined.

14. A cap according to claim 7, wherein a surface facing an edge portion of said toner filling opening of said cap is provided with an inclined surface toward a bulge.

15. A cap according to claim 14, wherein the height of said groove is not less than 0.4 mm and not more than 1.0 mm from a bottom portion of the groove of said cap.

16. A cap according to claim 7, wherein said cap has a cap knob portion, and said cap knob portion is provided with a reinforcing rib extending in the circumferential direction of said cap.

17. A cap according to claim 7, wherein a bottom portion of said cap has a thickness which is smaller than a thickness of another portion of said cap.

18. A cap according to claim 7, wherein said cap has a triangular configuration.

19. A cap according to claim 7, wherein said cap has a Rockwell hardness which is smaller than that of the body of said container.

20. A cap according to claim 19, wherein said cap has a Rockwell hardness not less than R30 and less than R80, and the main assembly of said container has a Rockwell hardness not less than R80 and less than R150.

21. A cap according to claim 7, wherein said cap has a bending elasticity which is smaller than that of the body of said container.

22. A cap according to claim 21, wherein said cap has a bending elasticity not less than 800 kg/cm$^2$, and less than 10000 kg/cm$^2$, and that of the body is not less than 20000 kg/cm$^2$ and less than 30000 kg/cm$^2$.

23. A cap according to claim 7, wherein said cap has a tensile yield point which is smaller than that of the body of said container.

24. A cap according to claim 23, wherein said cap has a tensile yield point not less than 80 kg/cm$^2$ and less than 200 kg/cm$^2$, and the main assembly of said container has a tensile yield point not less than 250 kg/cm$^2$ and less than 500 kg/cm$^2$.

25. A cap according to claim 7, wherein said cap is produced through a low density polyethylene injection molding.

26. A cap according to claim 7, wherein said engaging portion is at an edge portion of said toner filling opening.

27. A toner cap according to claim 7, wherein an edge portion of said engaging portion contacts said groove.

28. A toner accommodation container for an electrophotographic image forming apparatus comprising:

(a) a main body of a container for accommodating toner;

(b) a toner filling opening for filling the toner into the body, said filling opening being provided in one side surface of said main body;

(c) an engaging portion provided in said main body; and (d) a toner cap for sealing said toner filling opening;

wherein said toner cap includes:

a sealing portion for sealing said toner filling opening; and a groove for engagement with said engaging portion;

wherein said toner filling opening is sealed by said toner cap with said engaging portion being engaged with said groove.

29. A container according to claim 28, wherein said engaging portion is at an edge portion of said toner filling opening.

30. A container according to claim 29, wherein an edge portion of said toner filling opening has a thickness which is larger than a width of a bottom portion of said groove measured along a short side thereof.

31. A container according to claim 30, wherein an outer surface of the edge portion of said filling opening is beveled into a C-shape.

32. A container according to claim 30, wherein an inner surface of said edge portion of the toner filling opening is rounded into not more than 0.3 mm.

33. A container according to claim 28, wherein a cap guide is provided at an outer periphery of said toner filling opening.

34. A container according to claim 33, wherein an inner size of said cap guide is such that after said cap is press-fitted into said toner filling opening, a play of not less than 0.1 mm and less than 2 mm exists all around it.

35. A container according to claim 28, wherein the main body of said container is produced through shock resistant polystyrene injection molding.

36. A container according to claim 28, wherein said groove extends all around an outer edge of said cap.

37. A container according to claim 28 or 36, further comprising a flange along an outer periphery thereof, wherein said flange is above said groove when said toner cap seals said toner filling opening.

38. A container according to claim 28 or 36, said toner cap further comprising a flat knob projected outwardly at a substantially central portion outside said toner cap, wherein said outside of said toner cap is outside said toner accommodation container when said toner cap seals said toner filling opening.

39. A container according to claim 38, further comprising a plurality of ribs extending from a portion where said knob is provided toward the periphery of said toner cap.

40. A container according to claim 39, wherein the height of said ribs is not less than 1.0 mm and not more than 3.0 mm.

41. A container according to claim 28, wherein a biting portion between said groove portion and an edge portion of said toner filling opening is linearly inclined.

42. A container according to claim 28, wherein a surface facing to an edge portion of said toner filling opening of said cap is provided with an inclined surface toward a bulge.

43. A container according to claim 42, wherein the height of said groove is not less than 0.4 mm and not more than 1.0 mm from a bottom portion of the groove of said cap.

44. A container according to claim 28, wherein said toner cap has a cap knob portion, and said cap knob portion is provided with a reinforcing rib extending in the circumferential direction of said toner cap.

45. A container according to claim 28, wherein a bottom portion of said cap has a thickness which is smaller than a thickness of another portion thereof.

46. A container according to claim 28, wherein said cap has a triangular configuration.

47. A container according to claim 28, wherein said cap has a Rockwell hardness which is smaller than that of the body of said container.

48. A container according to claim 47, wherein said cap has a Rockwell hardness not less than R30 and less than R80, and the main assembly of said container has a Rockwell hardness not less than R80 and less than R150.

49. A container according to claim 28, wherein said cap has a bending elasticity which is smaller than that of the body of said container.

50. A container according to claim 49, wherein said cap has a bending elasticity not less than 800 kg/cm$^2$, and less than 10000 kg/cm$^2$, and that of the body is not less than 20000 kg/cm$^2$ and less than 30000 kg/cm$^2$.

51. A container according to claim 28, wherein said cap has a tensile yield point which is smaller than that of the body of said container.

52. A container according to claim 51, wherein said cap has a tensile yield point not less than 80 kg/cm$^2$ and less than 200 kg/cm$^2$, and the main assembly of said container has a tensile yield point not less than 250 kg/cm$^2$ and less than 500 kg/cm$^2$.

53. A container according to claim 28, wherein said cap is produced through a low density polyethylene injection molding.

54. A container according to claim 28, wherein an edge portion of said engaging portion contacts said groove.

55. A process cartridge detachably mountable to a main assembly of an electrophotographic image forming apparatus, comprising:

an electrophotographic photosensitive member;

a developing member for developing a latent image formed on the photosensitive member with toner;

a toner container for accommodating the toner, said toner container including:

(a) a main body of a container for accommodating toner;

(b) a toner filling opening for filling the toner into the body, said filling opening being provided in one side surface of said main body;

(c) an engaging portion provided in said main body; and (d) a toner cap for sealing said toner filling opening; said toner cap including:

a sealing portion for sealing said toner filling opening; and a groove for engagement with said engaging portion;

wherein said toner filling opening is sealed by said toner cap with said engaging portion being engaged with said groove.

56. A process cartridge according to claim 55, wherein said process cartridge has a charging member for charging said electrophotographic photosensitive member.

57. A process cartridge according to claim 55 or 56, further comprising a cleaning member for removing the toner from said electrophotographic photosensitive member.

58. A process cartridge according to claim 55, wherein said engaging portion is at an edge portion of said toner filling opening.

59. A process cartridge according to claim 58, wherein an edge portion of said filling opening has a thickness which is larger than a width of a bottom portion of said groove measured along a short side thereof.

60. A process cartridge according to claim 59, wherein an outer surface of the edge portion of said filling opening is beveled into a C-shape.

61. A process cartridge according to claim 59 or 60, wherein an inner surface of said edge portion of the filling opening is rounded into not more than 0.3 mm.

62. A process cartridge according to claim 55, wherein a cap guide is provided at an outer periphery of said filling opening.

63. A process cartridge according to claim 62, wherein an inner size of said cap guide is such that after said cap is press-fitted into said filling opening, a play of not less than 0.1 mm and less than 2 mm exists all around it.

64. A process cartridge according to claim 55, wherein the main body of said container is produced through shock resistant polystyrene injection molding.

65. A process cartridge according to claim 55, wherein said groove extends all around an outer edge of said cap.

66. A process cartridge according to claim 55 or 65, said toner container further comprising a flange along an outer periphery thereof, wherein said flange is above said groove when said toner cap seals said toner filling opening.

67. A process cartridge according to claim 55 or 65, said toner cap further comprising a flat knob projected outwardly at a substantially central portion outside said cap, wherein said outside of said cap is outside said toner container when said toner cap seals said toner filling opening.

68. A process cartridge according to claim 67, further comprising a plurality of ribs extending from a portion where said knob is provided in an outer peripheral direction.

69. A process cartridge according to claim 68, wherein the height of said ribs is not less than 1.0 mm and not more than 3.0 mm.

70. A process cartridge according to claim 55, wherein a biting portion between said groove portion and an edge portion of said toner filling opening is linearly inclined.

71. A process cartridge according to claim 55, wherein a surface facing an edge portion of said toner filling opening of said cap is provided with an inclined surface toward a bulge.

72. A process cartridge according to claim 71, wherein the height of said groove is not less than 0.4 mm and not more than 1.0 mm from a bottom portion of the groove of said cap.

73. A process cartridge according to claim 55, wherein said cap has a cap knob portion, and said cap knob portion is provided with a reinforcing rib extending in the circumferential direction of said cap.

74. A process cartridge according to claim 55, wherein a bottom portion of said cap has a thickness which is smaller than a thickness of another portion of said toner cap.

75. A process cartridge according to claim 55, wherein said cap has a triangular configuration.

76. A process cartridge according to claim 55, wherein said cap has a Rockwell hardness which is smaller than that of the body of said container.

77. A process cartridge according to claim 76, wherein said cap has a Rockwell hardness not less than R30 and less than R80, and the main assembly of said container has a Rockwell hardness not less than R80 and less than R150.

78. A process cartridge according to claim 55, wherein said cap has a bending elasticity which is smaller than that of the body of said container.

79. A process cartridge according to claim 78, wherein said cap has a bending elasticity not less than 800 kg/cm$^2$, and less than 10000 kg/cm$^2$, and that of the body is not less than 20000 kg/cm$^2$ and less than 30000 kg/cm$^2$.

80. A process cartridge according to claim 55, wherein said cap has a tensile yield point which is smaller than that of the body of said container.

81. A process cartridge according to claim 80, wherein said cap has a tensile yield point not less than 80 kg/cm$^2$ and less than 200 kg/cm$^2$, and the main assembly of said container has a tensile yield point not less than 250 kg/cm$^2$ and less than 500 kg/cm$^2$.

82. A process cartridge according to claim 55, wherein said cap is produced through a low density polyethylene injection molding.

83. A process cartridge according to claim 55, wherein an edge portion of said engaging portion contacts said groove.

84. A toner cap for sealing a toner filling opening for filling toner into a body of a toner accommodation container for accommodating the toner wherein the toner cap has a basic wall thickness, the toner cap comprising:

a plurality of sides, each having a straight wall portion;

a groove portion, positioned on the outside of said plurality of sides, for engagement with an engaging portion provided in the body of said toner accommodation container, wherein said groove portion comprises two opposed side wall surfaces and one bottom surface and extends all around an outer edge of said cap, wherein the width of the bottom surface is less than the thickness of a brim portion of the toner filling opening so that the toner accommodation container is sealed by the toner cap as the brim portion of the toner filling opening is forced to wedge into the groove portion of the toner cap when the toner cap is fitted to the toner filling opening, wherein said groove portion and the toner filling opening are configured and positioned to leave a gap between the bottom surface of said groove portion and a brim portion of the toner filling opening when the toner cap caps the toner filling opening;

a bulge portion adjacent said groove portion, said bulge portion having a slanted surface which permits said toner cap to be smoothly pressed into the toner filling opening;

a bottom wall, adjacent to said bulge portion, wherein the thickness of said bottom wall is less than the basic wall thickness of the toner cap to minimize deformation of the toner cap that occurs during capping of the toner accommodation container with the toner cap, so that creeping of the toner accommodation container wall, which can occur on the back side of said groove portion, is prevented;

a knob portion provided at substantially the center of the toner cap;

a plurality of reinforcement ribs extending from said knob portion to a peripheral portion of said straight wall portions to prevent the straight wall portions from being bent and declining in sealing ability after the toner cap is fitted to the toner filling opening; and a slanted surface and a slanted internal surface, extending from different portions of at least one of said plurality of sides of said toner cap to minimize the deformation of the toner cap that occurs during capping of the toner filling opening with the toner cap and to prevent creeping that is liable to occur on the back side of the groove portion.

85. A process cartridge detachably mountable to a main assembly of an electrophotographic image forming apparatus, comprising:

an electrophotographic photosensitive member;

a developing member for developing a latent image formed on the photosensitive member with toner;

a toner container for accommodating the toner, said toner container including:

(a) a main body of a container for accommodating toner;

(b) a toner filling opening for filling the toner into the body, said filling opening being provided in one side surface of said main body;

(c) an engaging portion provided in said main body;

(d) a brim portion around the toner filling opening; and (e) a toner cap for sealing said toner filling opening, wherein the toner cap has a basic wall thickness;

said toner cap including:

a plurality of sides, each having a straight wall portion;

a groove portion, positioned on the outside of said plurality of sides, for engagement with said engaging portion, wherein said groove portion comprises two opposed side wall surfaces and one bottom surface and extends all around an outer edge of said toner cap, wherein the width of the bottom surface is less than the thickness of said brim portion so that the toner container is sealed by the toner cap as the brim portion of the toner filling opening is forced to wedge into the groove portion of the toner cap when the toner cap is fitted to the toner filling opening, wherein said groove portion and the toner filling opening are configured and positioned to leave a gap between the bottom surface of said groove portion and a brim portion of the toner filling opening when the toner cap caps the toner filling opening;

a bulge portion adjacent said groove portion, said bulge portion having a slanted surface which permits said toner cap to be smoothly pressed into the toner filling opening;

a bottom wall, adjacent to said bulge portion, wherein the thickness of said bottom wall is less than the basic wall thickness of the toner cap to minimize deformation of the toner cap that occurs during capping of the toner container with the toner cap, so that creeping of the toner container wall, which can occur on the back side of said groove portion, is prevented;

a knob portion provided at substantially the center of the toner cap;

a plurality of reinforcement ribs extending from said knob portion to a peripheral portion of said straight wall portions to prevent the straight wall portions from being bent and declining in sealing ability after the toner cap is fitted to the toner filling opening; and a slanted surface and a slanted internal surface, extending from different portions of at least one of said plurality of sides of said toner cap to minimize the deformation of the toner cap that occurs during capping of the toner filling opening with the toner cap and to prevent creeping that is liable to occur on the back side of the groove portion.

86. A toner cap for sealing a toner filling opening for filling toner into a body of a toner accommodation container for accommodating the toner, wherein the toner cap has a basic wall thickness and straight wall portions, the toner cap comprising:

a groove portion, for engagement with an engaging portion provided in the body of said toner accommodation container, wherein said groove portion comprises two opposed side wall surfaces and one bottom surface and extends all around an outer edge of said cap, wherein the width of the bottom surface is less than the thickness of a brim portion of the toner filling opening so that the toner accommodation container is sealed by the toner cap as the brim portion of the toner filling opening is forced to wedge into the groove portion of the toner cap when the toner cap is fitted to the toner filling opening, wherein said groove portion and the toner filling opening are configured and positioned to leave a gap between the bottom surface of said groove portion and a brim portion of the toner filling opening when the toner cap caps the toner filling opening;

a bulge portion adjacent said groove portion, said bulge portion having a slanted surface which permits said toner cap to be smoothly pressed into the toner filling opening;

a bottom wall, adjacent to said bulge portion, wherein the thickness of said bottom wall is less than the basic wall thickness of the toner cap to minimize deformation of the toner cap that occurs during capping of the toner accommodation container with the toner cap, so that creeping of the toner accommodation container wall, which can occur on the back side of said groove portion, is prevented;

a knob portion provided at substantially the center of the toner cap;

a plurality of reinforcement ribs extending from said knob portion to an outer peripheral portion to prevent the straight wall portions of said toner cap from being bent and declining in sealing ability after the toner cap is fitted to the toner filling opening; and a slanted surface and a slanted internal surface, extending from different portions of at least one of a plurality of sides of said toner cap to minimize the deformation of the toner cap that occurs during capping of the toner filling opening with the toner cap and to prevent creeping that is liable to occur on the back side of the groove portion.

87. A process cartridge detachably mountable to a main assembly of an electrophotographic image forming apparatus, comprising:

an electrophotographic photosensitive member;

a developing member for developing a latent image formed on the photosensitive member with toner;

a toner container for accommodating the toner, said toner container including:

(a) a main body of a container for accommodating toner;

(b) a toner filling opening for filling the toner into the body, said filling opening being provided in one side surface of said main body;

(c) an engaging portion provided in said main body;

(d) a brim portion around the toner filling opening; and (e) a toner cap for sealing said toner filling opening, wherein the toner cap has a basic wall thickness and straight wall portions;

said toner cap including:

a groove portion, for engagement with said engaging portion, wherein said groove portion comprises two opposed side wall surfaces and one bottom surface and extends all around an outer edge of said toner cap, wherein the width of the bottom surface is less than the thickness of said brim portion so that the toner container is sealed by the toner cap as the brim portion of the toner filling opening is forced to wedge into the groove portion of the toner cap when the toner cap is fitted to the toner filling opening, wherein said groove portion and the toner filling opening are configured and positioned to leave a gap between the bottom surface of said groove portion and a brim portion of the toner filling opening when the toner cap caps the toner filling opening;

a bulge portion adjacent said groove portion, said bulge portion having a slanted surface which permits said toner cap to be smoothly pressed into the toner filling opening;

a bottom wall, adjacent to said bulge portion, wherein the thickness of said bottom wall is less than the basic wall thickness of the toner cap to minimize deformation of the toner cap that occurs during capping of the toner container with the toner cap, so that creeping of the toner container wall, which can occur on the back side of said groove portion, is prevented;

a knob portion provided at substantially the center of the toner cap;

a plurality of reinforcement ribs extending from said knob portion to an outer peripheral portion to prevent the straight wall portions from being bent and declining in sealing ability after the toner cap is fitted to the toner filling opening; and a slanted surface and a slanted internal surface, extending from different portions of at least one of a plurality of sides of said toner cap to minimize the deformation of the toner cap that occurs during capping of the toner filling opening with the toner cap and to prevent creeping that is liable to occur on the back side of the groove portion.

88. A toner cap for sealing a toner filling opening for filling toner into a body of a toner accommodation container for accommodating the toner, the toner cap comprising:

a sealing portion;

a groove portion, formed in said sealing portion all therearound, for engagement with a brim portion provided around inside of the toner filling opening in the body of the toner accommodation container, wherein said groove portion is defined by two opposed surfaces and one bottom surface and extends all around an outer surface of said sealing portion, wherein a width of the bottom surface is less than a thickness of the brim portion so that the toner accommodation container is sealed by the toner cap when the toner cap is fitted into the toner filling opening, wherein said groove portion and the toner filling opening are configured and positioned to leave a gap between the bottom surface of said groove portion and the brim portion when the toner cap caps the toner filling opening;

a bulge portion adjacent said groove portion, said bulge portion having a slanted surface which permits said toner cap to be smoothly pressed into the toner filling opening;

a knob portion provided at substantially the center of the toner cap; and a plurality of reinforcement ribs each extending from a slanted surface adjacent said knob portion to a surface opposite from said bottom surface.

89. A process cartridge detachably mountable to a main assembly to an electrophotographic image forming apparatus, comprising:

an electrophotographic photosensitive member;

a developing member for developing to a latent image formed on the photosensitive member with a toner;

a toner container for accommodating the toner, said toner container including:

(a) a main body;

(b) a toner filling opening for filling the toner into the main body;

(c) a brim portion around the toner filling opening; and (d) a toner cap for sealing of said toner filling opening, said toner cap including:

a sealing portion;

a groove portion, formed in said sealing portion all therearound, for engagement with the brim portion provided around inside of the toner filling opening in the body of the toner accommodation container, wherein said groove portion is defined by two opposed surfaces and one bottom surface and extends all around an outer surface of said sealing portion, wherein a width of the bottom surface is less than a thickness of the brim portion so that the toner accommodation container is sealed by the toner cap when the toner cap is fitted into the toner filling opening, wherein said groove portion and the toner filling opening are configured and positioned to leave a gap between the bottom surface of the said groove portion and the brim portion when the toner cap caps the toner fillings opening;

a bulge portion adjacent said groove portion, said bulge portion having a slanted surface which permits said toner cap to be smoothly pressed into the toner filing opening;

a knob portion provided at substantially the center of the toner cap; and a plurality of reinforcement ribs each extending from a slated surface adjacent said knob portion to a surface opposite from said bottom surface.

90. A toner cap for sealing a toner filling opening for filling toner into a body of a toner accommodation container for accommodating the toner, the toner cap comprising:

a wall portion;

a groove portion, for engagement with a brim portion provided around inside of the toner filling opening in the body of the toner accommodation container, wherein said groove portion is defined by two opposed surfaces and one bottom surface and extends all around an outer surface of said wall portion, wherein a width of the bottom surface is less than a thickness of the brim portion so that the toner accommodation container is sealed by the toner cap when the toner cap is fitted into the toner filing opening, wherein said groove portion and the toner filling opening are configured and positioned to leave a gap between the bottom surface of the said groove portion and the brim portion when the toner cap caps the toner filling opening;

a bulge portion adjacent said groove portion, said bulge portion having a slanted surface which permits said toner cap to be smoothly pressed into the toner filing opening;

a knob portion provided at substantially the center of the toner cap; and a plurality of reinforcement ribs each extending from a slated surface adjacent said knob portion to a surface opposite from said bottom surface.

91. A process cartridge detachably mountable to a main assembly to an electrophotographic image forming apparatus, comprising:

an electrophotographic photosensitive member;

a developing member for developing to a latent image formed on the photosensitive member with toner;

a toner container for accommodating the toner, said toner container including:

(a) a main body;

(b) a toner filling opening for filling the toner into the main body;

(c) a brim portion around the toner filling opening; and (d) a toner cap for sealing of said toner filing opening, said toner cap including:

a wall portion;

a groove portion, for engagement with the brim portion provided around the inside of the toner filling opening in the body of the toner accommodation container, wherein said groove portion is defined by two opposed surfaces and one bottom surface and extends all around an outer surface of said wall portion, wherein a width of the bottom surface is less than a thickness of the brim portion so that the toner accommodation container is sealed by the toner cap when the toner cap is fitted into the toner filling opening, wherein said groove portion and the toner filling opening are configured and positioned to leave a gap between the bottom surface of the said groove portion and the brim portion when the toner cap caps the toner filling opening;

a bulge portion adjacent said groove portion, said bulge portion having a slanted surface which permits said toner cap to be smoothly pressed into the toner filing opening;

a knob portion provided at substantially the center of the toner cap; and a plurality of reinforcement ribs each extending from a slated surface adjacent said knob portion to a surface opposite from said bottom surface.

* * * * *

UNITED STATES PATENT AND TRADEMARK OFFICE

CERTIFICATE OF CORRECTION

PATENT NO. : 6,246,848 B1
DATED : June 12, 2001
INVENTOR(S) : Hiroumi Morinaga et al.

It is certified that error appears in the above-identified patent and that said Letters Patent is hereby corrected as shown below:

Column 2,
Line 57, “view” should read -- views --.

Column 6,
Line 10, “filing” should read -- filling --; and
Line 31, “test” should read -- tested --.

Column 8,
Line 15, “3b, a” should read -- 3b, --.

Column 9,
Line 6, “member 9c” should read -- member 9e --.
Line 63, “9c” should read -- 9e --.

Column 10,
Line 49, “mains” should read -- main --.

Column 11,
Line 12, “an” should read -- a --.

Column 13,
Line 7, “snap-fitting” should read -- snap-fitted --.

Column 14,
Line 22, “(detail” should read -- (details --.

Column 15,
Line 19, “time, a” should read -- time, --; and
Line 31, “melt” should read -- melted --.

Column 16,
Line 9, “the almost entire length of theirs” should read -- almost their entire length --; and
Line 47, “This,” should read -- Thus, --.

Column 17,
Line 37, “the creeping the” should read -- the creeping with respect to the --; and
Line 46, “5A” should read -- A5 --.

UNITED STATES PATENT AND TRADEMARK OFFICE

CERTIFICATE OF CORRECTION

PATENT NO. : 6,246,848 B1
DATED : June 12, 2001
INVENTOR(S) : Hiroumi Morinaga et al.

It is certified that error appears in the above-identified patent and that said Letters Patent is hereby corrected as shown below:

Column 18,
Line 23, "more" (2nd occurrence) should read -- most --;
Line 35, "mains" should read -- main --; and
Line 60, "improved the bottom" should read -- improved and the bottom --.

Column 19,
Line 6, "opening llf" should read -- opening lld --; and
Line 20, "lid" should read -- lld --.

Column 21,
Line 66, "its" should read -- it --.

Column 30,
Line 60, "inside" should read -- the inside --.

Column 31,
Line 20, "to a" should read -- a --;
Lines 33 and 61, "inside" should read -- the inside --; and
Line 54, "slated" should read -- slanted --.

Column 32,
Lines 7, 14, 33 and 55, "filing" should read -- filling --;
Lines 19 and 59, "slated" should read -- slanted --; and
Line 25, "to a" should read -- a --.

Signed and Sealed this

Eighteenth Day of November, 2003

JAMES E. ROGAN
*Director of the United States Patent and Trademark Office*